US010577928B2

(12) United States Patent
Wang et al.

(10) Patent No.: US 10,577,928 B2
(45) Date of Patent: Mar. 3, 2020

(54) FLOW REGIME IDENTIFICATION WITH FILTRATE CONTAMINATION MONITORING

(71) Applicant: Schlumberger Technology Corporation, Sugar Land, TX (US)

(72) Inventors: Kang Wang, Beijing (CN); Youxiang Zuo, Burnaby (CA); Ryan Sangjun Lee, Sugar Land, TX (US); Adriaan Gisolf, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 197 days.

(21) Appl. No.: 14/867,262

(22) Filed: Sep. 28, 2015

(65) Prior Publication Data

US 2016/0090836 A1 Mar. 31, 2016

Related U.S. Application Data

(63) Continuation-in-part of application No. 14/164,991, filed on Jan. 27, 2014.

(51) Int. Cl.
*E21B 49/08* (2006.01)

(52) U.S. Cl.
CPC ..... *E21B 49/08* (2013.01); *E21B 2049/085* (2013.01)

(58) Field of Classification Search
None
See application file for complete search history.

(56) References Cited

U.S. PATENT DOCUMENTS 6,729,400 B2 5/2004 Mullins et al.
6,956,204 B2 10/2005 Dong et al.
(Continued)

FOREIGN PATENT DOCUMENTS

GB 2419424 A 4/2006
WO 2008104750 A1 9/2008
(Continued)

OTHER PUBLICATIONS

Dong, C., et. al., "Focused Formation Fluid Sampling Method", Mar. 1, 2006, downloaded from URL<http://www.offshore-mag.com/articles/print/volume-66/issue-3/drilling-completion/focused-formation-fluid-sampling-method.html> on Sep. 5, 2017.*
(Continued)

*Primary Examiner* — J. E. Schoenholtz
(74) *Attorney, Agent, or Firm* — Trevor G. Grove

(57) ABSTRACT

A method includes operating a downhole acquisition tool in a wellbore in a geological formation. The wellbore or the geological formation, or both contains a fluid that includes a native reservoir fluid of the geological formation and a contaminant. The method also includes receiving a portion of the fluid into the downhole acquisition tool, measuring a fluid property of the portion of the fluid using the downhole acquisition tool, and using the processor to estimate a fluid property of the native reservoir fluid based on the measured fluid property of the portion of the fluid and a regression model that may predict an asymptote of a growth curve. The asymptote corresponds to the estimated fluid property of the native formation fluid, and the regression model includes a geometric fitting model other than a power-law model.

14 Claims, 22 Drawing Sheets

(56) References Cited

U.S. PATENT DOCUMENTS

| | | | | |
|---|---|---|---|---|
| 7,028,773 | B2 | 4/2006 | Fujisawa et al. | |
| 7,920,970 | B2 | 4/2011 | Zuo et al. | |
| 8,024,125 | B2 | 9/2011 | Hsu et al. | |
| 8,201,625 | B2 * | 6/2012 | Almaguer | E21B 7/061 166/250.08 |
| 9,733,389 | B2 | 8/2017 | Hsu et al. | |
| 2003/0220775 | A1 | 11/2003 | Jourdan et al. | |
| 2004/0193375 | A1 | 9/2004 | Dong et al. | |
| 2005/0182566 | A1 | 8/2005 | DiFoggio | |
| 2006/0155474 | A1 | 7/2006 | Venkataramanan et al. | |
| 2006/0241866 | A1 | 10/2006 | DiFoggio | |
| 2007/0079962 | A1 * | 4/2007 | Zazovsky | E21B 49/008 166/264 |
| 2008/0073078 | A1 | 3/2008 | Sherwood | |
| 2008/0125973 | A1 | 5/2008 | Sherwood et al. | |
| 2008/0156088 | A1 | 7/2008 | Hsu et al. | |
| 2009/0166085 | A1 | 7/2009 | Ciglenec et al. | |
| 2010/0175873 | A1 * | 7/2010 | Milkovisch | E21B 49/008 166/264 |
| 2010/0294491 | A1 | 11/2010 | Zazovsky | |
| 2012/0053838 | A1 * | 3/2012 | Andrews | E21B 49/082 702/8 |
| 2013/0311099 | A1 * | 11/2013 | Eyuboglu | E21B 49/081 702/11 |
| 2014/0180591 | A1 | 6/2014 | Hsu et al. | |
| 2014/0316705 | A1 | 10/2014 | Zuo et al. | |
| 2015/0135814 | A1 | 5/2015 | Zuo et al. | |
| 2015/0142317 | A1 | 5/2015 | Zuo et al. | |
| 2015/0211361 | A1 | 7/2015 | Gisolf et al. | |
| 2015/0226059 | A1 | 8/2015 | Zuo et al. | |
| 2015/0292324 | A1 | 10/2015 | Jackson et al. | |
| 2015/0308261 | A1 | 10/2015 | Zuo et al. | |
| 2015/0308264 | A1 | 10/2015 | Zuo et al. | |
| 2016/0061743 | A1 | 3/2016 | Wang et al. | |
| 2016/0130940 | A1 | 5/2016 | Hsu et al. | |

FOREIGN PATENT DOCUMENTS

| | | | |
|---|---|---|---|
| WO | 2010062635 | A2 | 6/2010 |
| WO | 2011138700 | A2 | 11/2011 |

OTHER PUBLICATIONS

Nguyen, T., "Drilling Engineering—PE311 Chapter 2: Drilling Fluids Introduction to Drilling Fluids", New Mexico Tech., Fall 2012.*

Dong, C., et. al., "Focused formation fluid sampling method", Mar. 1, 2006 downloaded from URL< https://www.offshore-mag.com/index.html> on Sep. 5, 2017.*

Examination Report issued in the related GB Application No. GB1501318.8, dated Mar. 7, 2016 (2 pages).

U.S. Appl. No. 14/836,965, filed Aug. 27, 2015.

U.S. Appl. No. 14/697,382, filed Apr. 27, 2015.

U.S. Appl. No. 14/534,813, filed Nov. 6, 2014.

U.S. Appl. No. 14/263,893, filed Apr. 28, 2014.

U.S. Appl. No. 14/248,528, filed Apr. 9, 2014.

Combined Search and Examination Report for GB Application No. GB1501318.8 dated Jun. 11, 2015.

Kristensen et al. "Flow Modeling and Comparative Analysis for a New Generation of Wireline Formation Tester Modules," IPTC 17385, International Petroleum Technology Conference, Doha, Qatar, Jan. 20-22, 2014, pp. 1-14.

Sherwood, D.J. "Fluid Sampling from Porous Rock to Determine Filtrate Contamination Profiles around a Well Bore", Transp Porous Med (2010) 81:479-503.

Zuo, et al. "A New Method for OBM Decontamination in Downhole Fluid Analysis", IPTC 16524, International Petroleum Technology Conference, Beijing, China, Mar. 26-28, 2013, pp. 1-8.

Office Action issued in the related U.S. Appl. No. 14/164,991, dated Jun. 3, 2019 (15 pages).

* cited by examiner

FLOW REGIME IDENTIFICATION WITH FILTRATE CONTAMINATION MONITORING

CROSS-REFERENCE TO RELATED APPLICATIONS

This application is a continuation-in-part of U.S. application Ser. No. 14/164,991 filed Jan. 27, 2014, the contents of which are hereby incorporated by reference in their entirety for all purposes.

BACKGROUND

This disclosure relates to determining oil-based mud contamination of native formation fluids downhole.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Wells can be drilled into a surface location or ocean bed to access fluids, such as liquid and gaseous hydrocarbons, stored in geological formations. The formations through which the well passes can be evaluated for a variety of properties, including but not limited to the presence of hydrocarbon reservoirs in the formation. Wells may be drilled using a drill bit attached to the end of a "drill string," which includes a drillpipe, a bottomhole assembly, and additional components that facilitate rotation of the drill bit to create a borehole. During the drilling process, drilling fluid, which may be referred to as "mud," is pumped through the drill string to the drill bit. The drilling fluid provides lubrication and cooling to the drill bit during the drilling operation, and also evacuates any drill cuttings to the surface through an annular channel between the drill string and borehole wall. Drilling fluid that invades the surrounding formation may be referred to as "filtrate."

It may be desirable to evaluate the geological formation through which the borehole passes for oil and gas exploration (e.g., to locate hydrocarbon-producing regions in the geological formation and/or to manage production of the hydrocarbons in these regions). Evaluation of the geological formation may include determining certain properties of the fluids stored in the subsurface formations. When a sample of the fluid in the borehole is collected for evaluation of the subsurface formation, the sample fluid may include formation fluid, filtrate, and/or drilling fluid. As used herein, "formation fluid" refers broadly to any fluid (e.g., oil and gas) naturally stored in the surrounding subsurface formation. To sample or test the fluid, a downhole acquisition tool may be moved into the wellbore to draw in the fluid.

Fluids other than native reservoir fluid (e.g., uncontaminated formation fluid) may contaminate the native reservoir fluid. Therefore, the fluid drawn from the wellbore may be a mixture of native reservoir fluid and drilling mud filtrate. Of certain concern are oil-based mud drilling fluids that may be miscible with certain native reservoir fluids (e.g., oil and gas). The miscibility of the oil-based mud and the native reservoir fluid may cause difficulties in evaluation of the native reservoir fluid for assessing the hydrocarbon regions; in particular, the region's economic value. Accordingly, the collection of the native formation fluid may involve drawing fluid into the borehole and/or the downhole acquisition tool to establish a cleanup flow and remove the mud filtrate contaminating the formation fluid.

SUMMARY

This summary is provided to introduce a selection of concepts that are further described below in the detailed description. This summary is not intended to identify key or essential features of the subject matter described herein, nor is it intended to be used as an aid in limiting the scope of the subject matter described herein. Indeed, this disclosure may encompass a variety of aspects that may not be set forth below.

In one example, a method includes operating a downhole acquisition tool in a wellbore in a geological formation. The wellbore or the geological formation, or both contains a fluid that includes a native reservoir fluid of the geological formation and a contaminant. The method also includes receiving a portion of the fluid into the downhole acquisition tool, measuring a fluid property of the portion of the fluid using the downhole acquisition tool, and using the processor to estimate a fluid property of the native reservoir fluid based on the measured fluid property of the portion of the fluid and a regression model that may predict an asymptote of a growth curve. The asymptote corresponds to the estimated fluid property of the native formation fluid, and the regression model includes a geometric fitting model other than a power-law model.

In another example, a downhole fluid testing system includes a downhole acquisition tool housing that may be moved into a wellbore in a geological formation. The wellbore or the geological formation, or both, contains a fluid that includes a native reservoir fluid of the geological formation and a contaminant. The system also includes a sensor disposed in the downhole acquisition tool housing that may analyze portions of the fluid and obtain sets of fluid properties of the portions of the fluid and a data processing system that may estimate a fluid property of the native reservoir fluid based on at least one fluid property from the sets of fluid properties of the portion of the fluid and a geometric fitting model including two or more parameters. The geometric fitting model may predict an asymptote of a growth curve, and the asymptote corresponds to the estimated fluid property of the native formation fluid.

In another example, one or more tangible, non-transitory, machine-readable media including instructions to: receive a fluid parameter of a portion of fluid as analyzed by a focused downhole acquisition tool in a wellbore in a geological formation. The wellbore or the geological formation, or both, contains the fluid, the fluid includes a mixture of a native reservoir fluid of the geological formation and a contaminant. The one or more tangible, non-transitory, machine-readable media also includes instructions to estimate a fluid property of the native reservoir fluid based on the fluid parameter of the portion of the fluid and a geometric fitting model including two or more parameters. The geometric fitting model matches a decline curve associated with the contaminant in the mixture.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

In order to describe the manner in which the above-recited and other advantages and features of the disclosure can be obtained, a more particular description will be rendered by reference to specific embodiments thereof which are illustrated in the appended drawings. For better understanding, the like elements have been designated by like reference numbers throughout the various accompanying figures. Understanding that these drawings depict only typical embodiments of the disclosure and are not therefore to be considered to be limiting of its scope, the embodiments will be described and explained with additional specificity and detail through the use of the accompanying drawings in which:

FIG. 4-1 depicts a sensitivity simulation depicting graphs of cleanup rates for formations with a selection of absolute permeabilities over volume pumped;

FIG. 4-2 depicts a sensitivity simulation depicting graphs of cleanup rates for formations with a selection of absolute permeabilities over time;

FIG. 5-1 depicts a sensitivity simulation depicting graphs of cleanup rates for formations with a selection of permeability anisotropies over volume pumped;

FIG. 5-2 depicts a sensitivity simulation depicting graphs of cleanup rates for formations with a selection of permeability anisotropies over time;

FIG. 6-1 depicts a sensitivity simulation depicting graphs of cleanup rates for formations with a selection of viscosity ratios over volume pumped;

FIG. 6-2 depicts a sensitivity simulation depicting graphs of cleanup rates for formations with a selection of viscosity ratios over time;

FIG. 7-1 depicts a sensitivity simulation depicting graphs of cleanup rates for formations with a selection of filtrate invasion depths over volume pumped, in accordance with one or more embodiments of the present disclosure;

FIG. 7-2 depicts a sensitivity simulation depicting graphs of cleanup rates for formations with a selection of filtrate invasion depths over time, in accordance with one or more embodiments of the present disclosure;

DETAILED DESCRIPTION

Figure 1:
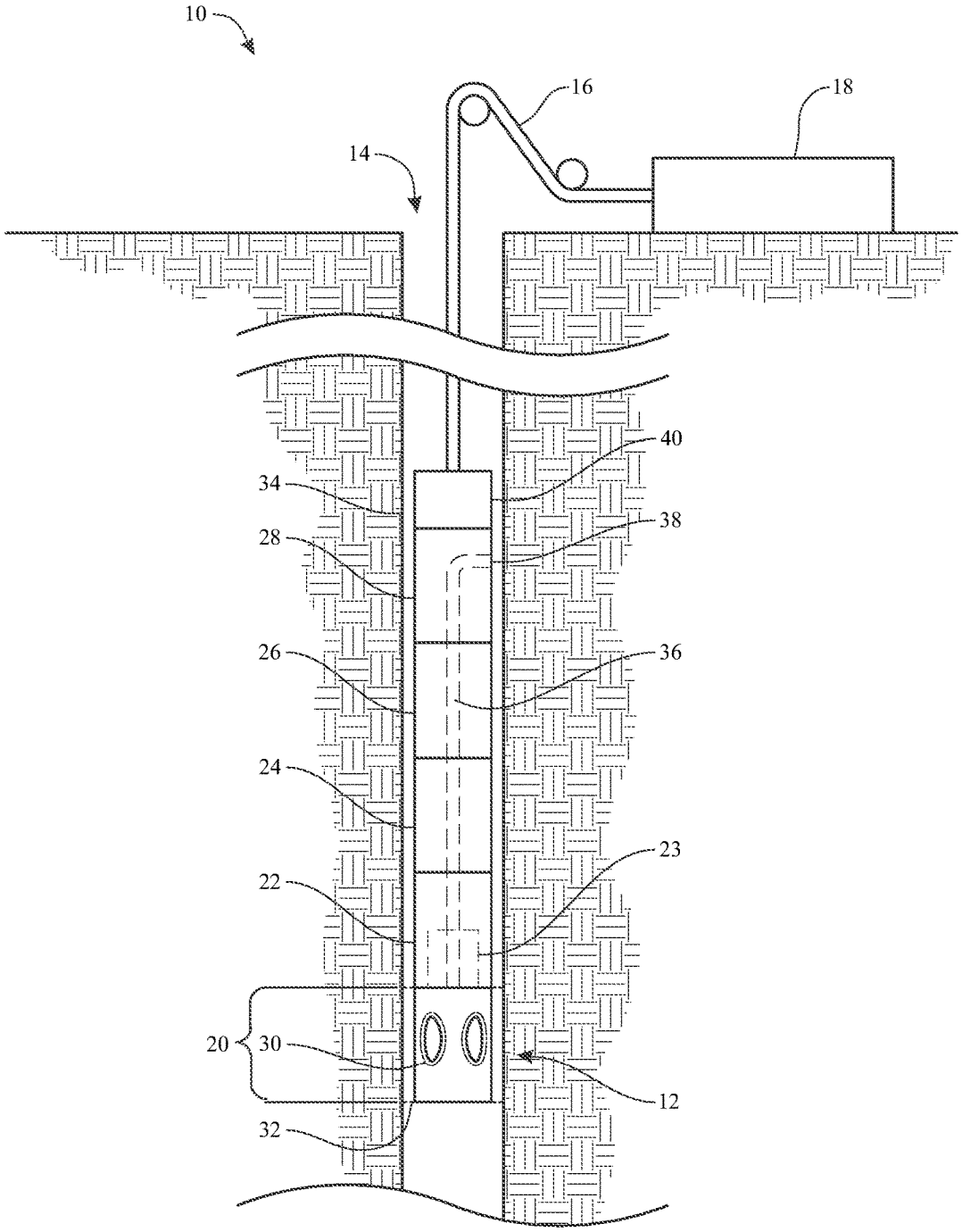
FIG. 1 is a side cross-sectional view of a well and formation testing system in accordance with one or more embodiments.

One or more specific embodiments of the present disclosure will be described below. These described embodiments are examples of the presently disclosed techniques. Additionally, in an effort to provide a concise description of these embodiments, not all features of an actual implementation may be described in the specification. It should be appreciated that in the development of any such actual implementation, as in any engineering or design project, numerous implementation-specific decisions will be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

This disclosure generally relates to sampling with a formation tester in a downhole tool to capture a fluid sample that is representative of a native formation fluid. During oil and gas exploration, the collection of a fluid sample that is representative of the surrounding formation fluid (e.g., the native reservoir fluid) may be desirable to measure and/or evaluate properties of the surrounding formation. A native reservoir fluid is a fluid, gaseous or liquid, that is trapped in a formation, which may be penetrated by a borehole. In many drilling operations, the borehole is drilled using a drilling fluid, also referred to as drilling mud, which is pumped down through the drill string and used to lubricate the drill bit. The drilling fluid may be oil-based or water-based. The drilling fluid returns to the surface carrying drill cuttings through an annular channel surrounding the drill string and within the borehole. During drilling, the drilling fluid may penetrate into the surrounding formation and contaminate the fluid stored in the formation near the borehole. Although the embodiments described herein may refer generally to formation testers in a downhole acquisition tool, the present disclosure is not limited to application in these environments.

The formation fluid can be drawn into the downhole acquisition tool and the contamination level of drilling fluid or mud filtrate within the fluid may be monitored. When the contamination level decreases to a desired level, a sample of the fluid may be stored within the downhole acquisition tool for retrieval to the surface, where further analysis may occur. Contamination monitoring employs knowledge of the native reservoir fluid properties. Once the native formation fluid properties are known, mixing rules can be used to determine the contamination of the fluid being pumped at any given time with a formation tester. Power laws are used to model the (change in) formation fluid properties resulting from the change in formation fluid to mud filtrate ratio, as fluid is pumped from the formation. Such models can then be extrapolated to obtain the native reservoir fluid properties. However, the entire fluid cleanup cannot be modeled with a single power law. Modeling data of changing power law exponent with a model that contains a fixed power law exponent creates a model mismatch. The systems and methods of this disclosure may determine when the cleanup behavior (data) follows a constant power law. The model now may be fitted on the measured data without model mismatch, allowing the native reservoir fluid properties to be obtained after model extrapolation.

Additionally, in certain focused sampling applications, power-law models may not match the clean-up data. For example, unlike unfocused sampling, flow regime identification may not be available for focused sampling. Accordingly, power-model exponents may be adjusted to match the clean-up data. In focused sampling applications, the power-law function exponent may be treated as an adjustable parameter for determining endpoint values of the native formation fluids and pure mud filtrate (e.g., oil-based and water-based mud filtrate). However, the endpoint values may be sensitive to the exponent of the power-law function and to fitting intervals. Therefore, due, in part, to the variability of the power-law function exponent in focused sampling, the power-law function may not properly match the clean-up data generated using focused sampling tools. As such, the endpoint values may be inaccurate, which may result in inaccurate contamination levels. As discussed in further detail below, an exponential function, rather than a power-law function, may be used to accurately determine endpoint values and contamination levels for focused sampling applications.

FIG. 1 depicts a wireline system 10 in accordance with an embodiment. While certain elements of the wireline system 10 are depicted in this figure and generally discussed below, it will be appreciated that the wireline system 10 may include other components in addition to, or in place of, those presently illustrated and discussed. As depicted, the wireline system 10 includes a sampling tool 12 (also referred to as a downhole acquisition tool) suspended in a well 14 from a cable 16. The sampling tool 12 may be a focused or an unfocused sampling tool. The cable 16 may be a wireline cable that may support the sampling tool 12 and may include at least one conductor that enables data communication between the sampling tool 12 and a control and monitoring system 18 disposed on the surface.

The cable 16, and hence the sampling tool 12, may be positioned within the well in any suitable manner. As an example, the cable 16 may be connected to a drum, allowing rotation of the drum to raise and lower the sampling tool 12. The drum may be disposed on a service truck or a stationary platform. The service truck or stationary platform may further contain the control and monitoring system 18. The control and monitoring system 18 may include one or more computer systems or devices and/or may be a distributed computer system. For example, collected data may be stored, distributed, communicated to an operator, and/or processed locally or remotely. The control and monitoring system 18 may, individually or in combination with other system components, perform the methods discussed below, or portions thereof.

The sampling tool 12 may include multiple components. For example, the sampling tool 12 includes a probe module 20, a fluid analysis module 22, a pump module 24, a power module 26, and a fluid sampling module 28. However, in further embodiments, the sampling tool 12 may include additional or fewer components. The probe module 20 of the sampling tool 12 includes one or more inlets 30 that may engage or be positioned adjacent to the wall 34 of the well 14. The one or more inlets 30 may be designed to provide focused or un-focused sampling. Furthermore, the probe module 20 also includes one or more deployable members 32 configured to place the inlets 30 into engagement with the wall 34 of the well 14. For example, as shown in FIG. 1, the deployable member 32 includes an inflatable packer that can be expanded circumferentially around the probe module 20 to extend the inlets 30 into engagement with the wall 34. In another embodiment, the one or more deployable members 32 may be one or more setting pistons that may be extended against one or more points on the wall of the well to urge the inlets 30 against the wall. In yet another embodiment, the inlets 30 may be disposed on one or more extendable probes designed to engage the wall 34.

The pump module 24 draws sample fluid through a flowline 36 that provides fluid communication between the one or more inlets 30 and the outlet 38. As shown in FIG. 1, the flowline 36 extends through the probe module 20 and the fluid analysis module 22 before reaching the pump module 24. However, in other embodiments, the arrangement of the modules 20, 22, and 24 may vary. For example, in certain embodiments, the fluid analysis module 22 may be disposed on the other side of the pump module 24. The flowline 36 also may extend through the power module 26 and the fluid sampling module 28 before reaching the outlet 38. The fluid sampling module 28 may selectively retain some fluid for storage and transport to the surface for further evaluation outside the borehole. The sampling tool 12 may also include a downhole controller 40 that may include one or more computer systems or devices and/or may be part of a distributed computer system. The downhole controller 40 may, individually or in combination with other system components (e.g., control and monitoring system 18), perform the methods discussed below, or portions thereof.

Figure 2:
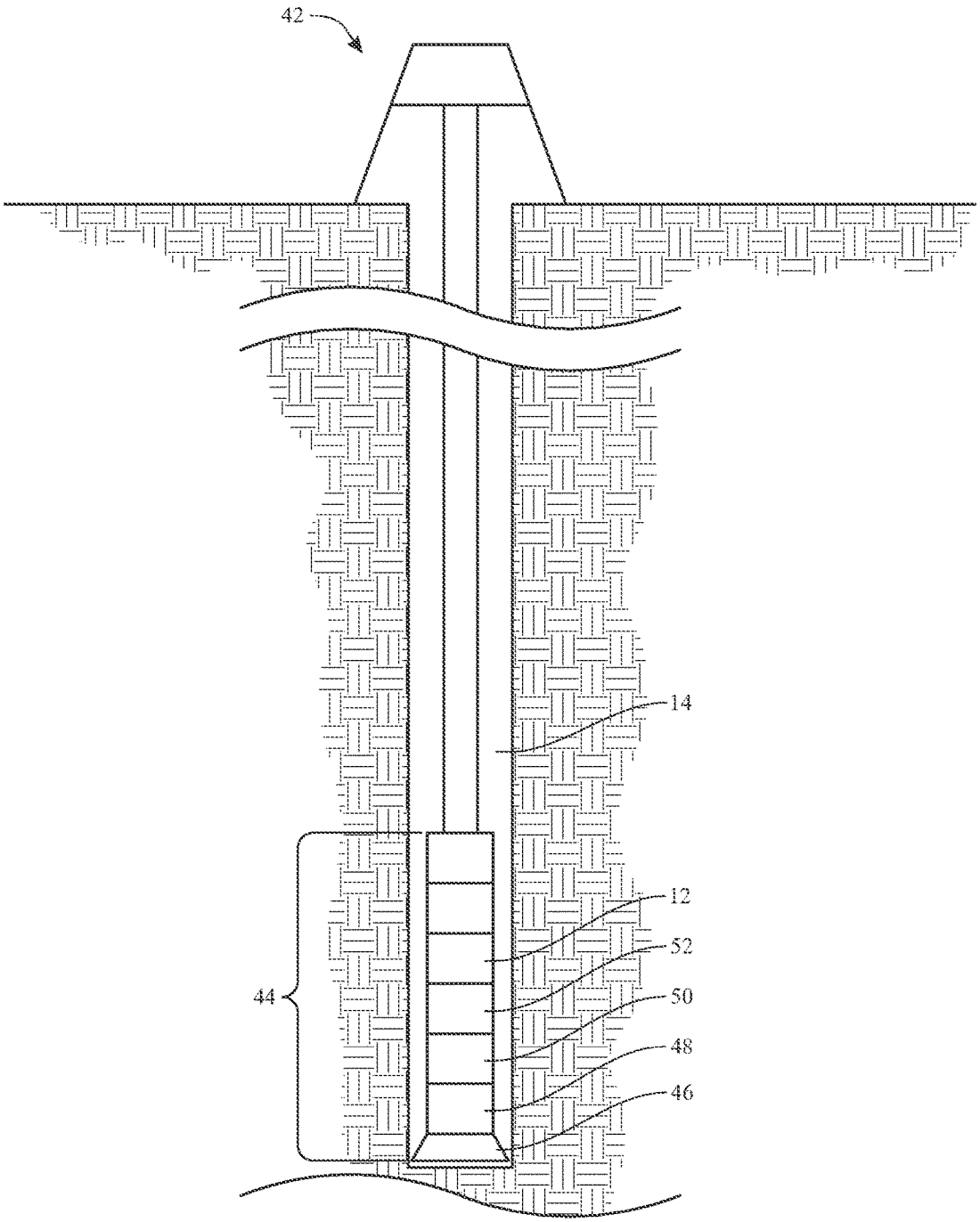
FIG. 2 is a side cross-sectional view of a well and drill string in accordance with one or more embodiments.

While FIG. 1 illustrates sampling being conducted with a single sample tool 12 in one borehole, it will be appreciated that other embodiments are contemplated. For instance, sampling may be conducted in a single borehole (e.g., the well 14) with one or more sampling tools 12 or conducted with one or more sampling tools 12 in each of a plurality of boreholes. Furthermore, while the sampling tool 12 is depicted in FIG. 1 as part of a wireline system, in other embodiments the sampling tool 12 may be a portion of a drilling system 42, as shown in FIG. 2. The drilling system 42 includes a bottomhole assembly 44 that includes data collection modules. For example, in addition to the drill bit 46 and steering module 48 for manipulating the orientation of the drill bit 46, the bottomhole assembly 44 includes a measurement-while-drilling (MWD) module 50 and a logging-while-drilling (LWD) module 52. The MWD module 50 is capable of collecting information about the rock and formation fluid properties within the well 14, and the LWD module 52 is capable of collecting characteristics of the bottomhole assembly 44 and the well 14, such as orientation (azimuth and inclination) of the drill bit 46, torque, shock and vibration, the weight on the drill bit 46, and downhole temperature and pressure. The MWD module 50 may be capable, therefore, of collecting real-time data during drilling that can facilitate formation analysis. Additionally, although depicted in an onshore well 14, wireline system 10 and drilling system 42 could instead be deployed in an offshore well. Further, in yet other embodiments, the sampling tool 12 may be conveyed within a well 14 on other conveyance means, such as wired drill pipe, or coiled tubing, among others.

Referring back to FIG. 1, fluid samples are collected with the sampling tool 12. The sampling tool 12 may be extended to various locations within the well 14 and fluid samples may be collected at those locations. The fluid samples may reflect gradients within a formation or represent the fluids contained within multiple formations through which the borehole penetrates. In order to capture a fluid sample that is representative of the formation fluid, the sampling device may need to pump out a larger volume of fluid than the sample. The pump-out volume may, in some cases, be larger than the sample size in order to remove the drilling fluid present immediately surrounding the sampling device in the borehole and the mixed fluid in the surrounding formation containing both the formation fluid and the drilling fluid. The process of removing fluid from the area surrounding the sampling device is referred to as filtrate cleanup and may be used when sampling formation fluid.

Monitoring of the cleanup process can be performed using downhole sensors capable of measuring properties such as optical density, gas-oil ratio, conductivity, density, compressibility, and other properties measurable through downhole fluid analysis ("DFA"). For instance, the fluid analysis module 22 may include a fluid analyzer 23 that can be employed to provide in situ downhole fluid measurements. For example, the fluid analyzer 23 may include a spectrometer and/or a gas analyzer designed to measure properties such as, optical density, fluid density, fluid viscosity, fluid fluorescence, fluid composition, and the fluid gas-oil ratio, among others. According to certain embodiments, the spectrometer may include any suitable number of measurement channels for detecting different wavelengths, and may include a filter-array spectrometer or a grating spectrometer. For example, the spectrometer may be a filter-array absorption spectrometer having ten measurement channels. In other embodiments, the spectrometer may have sixteen channels or twenty channels, and may be provided as a filter-array spectrometer or a grating spectrometer, or a combination thereof (e.g., a dual spectrometer), by way of example. According to certain embodiments, the gas analyzer may include one or more photodetector arrays that detect reflected light rays at certain angles of incidence. The gas analyzer also may include a light source, such as a light emitting diode, a prism, such as a sapphire prism, and a polarizer, among other components. In certain embodiments, the gas analyzer may include a gas detector and one or more fluorescence detectors designed to detect free gas bubbles and retrograde condensate liquid drop out.

One or more additional measurement devices, such as temperature sensors, pressure sensors, viscosity sensors, chemical sensors (e.g., for measuring pH or $H_2S$ levels), and gas chromatographs, may be included within the fluid analyzer. Further, the fluid analyzer 23 may include a resistivity sensor and a density sensor, which, for example, may be a densimeter or a densitometer. In certain embodiments, the fluid analysis module 22 may include a controller, such as a microprocessor or control circuitry, designed to calculate certain fluid properties based on the sensor measurements. Further, in certain embodiments, the controller may govern sampling operations based on the fluid measurements or properties. Moreover, in other embodiments, the controller may be disposed within another module of the downhole acquisition tool (e.g., the sampling tool 12).

The measurements taken during DFA may allow the estimation of contamination ratios using the known properties of the drilling fluid. For example, optical density measurements may be used to determine the ratio of filtrate to formation fluid using a power law function to fit measured data and extrapolate a formation fluid parameter. To determine the power law function to which the data is fit, the removal rate of the contaminating drilling fluid relative to the formation fluid may be considered.

Figure 3:
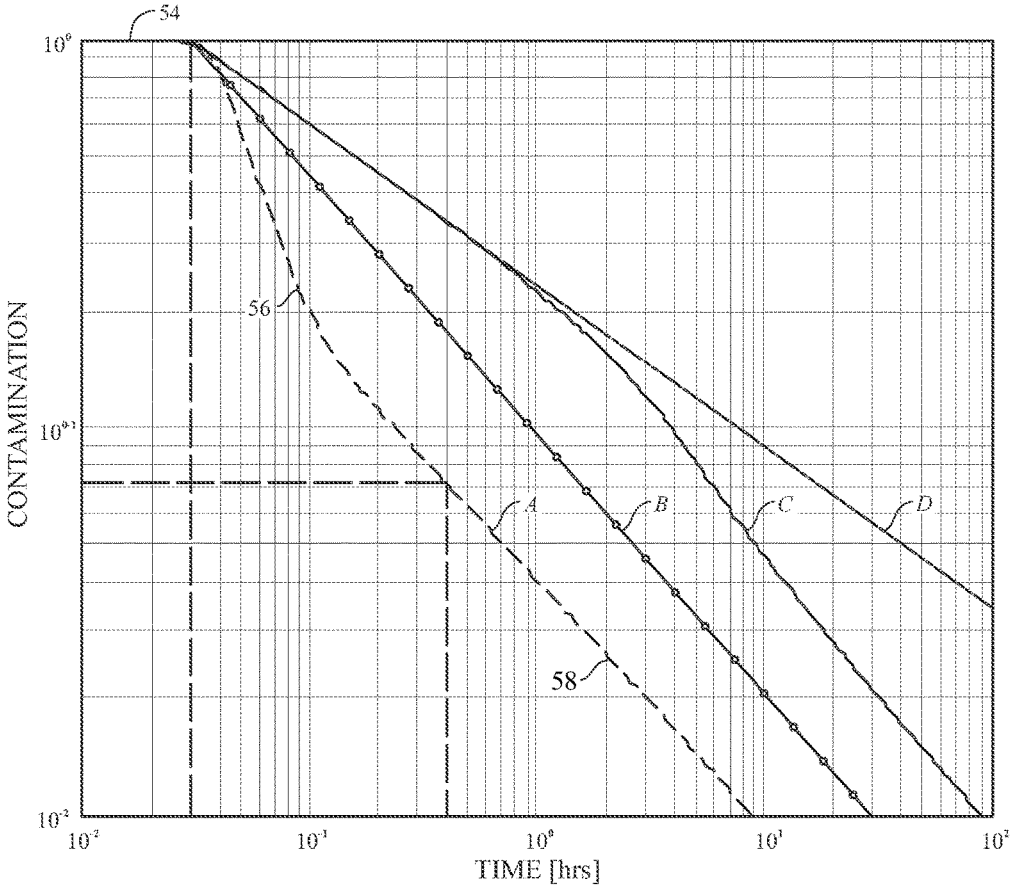
FIG. 3 is a graph depicting contamination clean up rates for different sampling devices.

As shown in FIG. 3, during pumpout of the sample fluid, the proportion of drilling fluid in the sample fluid changes in three distinct regimes: a first regime 54 of drilling fluid production, a second regime 56 just after formation fluid breakthrough, and a third regime 58 of developed flow. The first regime 54 relates to the period during which the pump out produces the drilling fluid adjacent the sampling device and drill string, with little or no formation fluid included in the fluid drawn into the downhole acquisition tool (e.g., the sampling tool 12). This first regime 54 may vary in duration depending on the type of sampling device, invasion depth, borehole size, and pump out rate, among others. The first regime 54 is associated with near 100% drilling fluid content, and therefore may be characterized by DFA and comparison of measured values against known values of the drilling fluid. When the region of pure drilling fluid in the borehole and immediately surrounding the sampling device has been evacuated, some formation fluid is drawn nearer the sampling device and the ratio of drilling fluid to formation fluid begins to decrease as more formation fluid is drawn into the downhole acquisition tool. This period of flow just after formation fluid breakthrough is an intermediate period that defines the second flow regime 56.

The second flow regime 56 correlates to a time of pumping out a high concentration of filtrate from the formation immediately surrounding the section of the borehole containing the sampling tool 12. In some embodiments, in the second flow regime 56, the clean-up rate is proportional to $V^{-5/12}$, where V is a pump-out volume. (Note that the pump-out volume value V may be replaced with a time value t when the pump rate is constant and therefore the time of pumping and volume pumped are correlated.) The contaminant pump out rate may vary in the second flow regime 56 depending on an inlet configuration on the sampling tool 12, as well as the type of sampling tool 12, among others. In certain embodiments, the intermediate second flow regime 56 physically corresponds to circumferential clean-up where filtrate is drawn from around the wellbore circumference at the level of the sampling tool 12 before flow to the sampling tool has been established from the region of the formation above and below the sampling tool 12.

The third flow regime 58 corresponds to a developed flow of fluid through the formation surrounding the sampling device. In some embodiments, the clean-up rate of the third flow regime 58 corresponds to a $V^{-2/3}$ power law function. Physically, this flow regime corresponds to a situation where all, or most of, the filtrate around the circumference of the wellbore at the level of the sampling device has been removed and filtrate instead flows vertically from above and below the sampling tool 12. The developed flow of the third flow regime 58 may allow measured fluid properties to be extrapolated to clean formation fluid properties using the power law function of the clean-up rate. Line A in FIG. 3 displays the cleanup rate of a radial probe while line B reflects a power law function having a −2/3 exponent. A radial probe may include one or more inlets disposed circumferentially about the body of the probe. In one embodiment, a radial probe may comprise multiple inlets with the multiple inlets spaced circumferentially around the body of the probe, such as probe 20 illustrated in FIG. 1. In another embodiment, a radial probe may comprise at least one inlet where the at least one inlet extends substantially circumferentially about the body of the probe. In some embodiments, the one or more inlets may be associated with extendable probes. The radial probe establishes the developed flow of the third flow regime 58 after a comparatively short second flow regime 56. Rapid attainment of the third flow regime 58 during use of a radial probe may enable earlier recognition of developed flow. In some embodiments, early recognition of developed flow may allow for earlier application of a cleanup flow model, resulting in reduced time for obtaining a clean formation fluid sample. Line C displays a single port probe and line D correlates to a power law function having a −5/12 exponent. Line C follows the behavior of a power law function having a −5/12 exponent until developed flow is established and then approximately follows the −2/3 exponent of the unfocused probe cleanup rate.

Figures 1, 6:
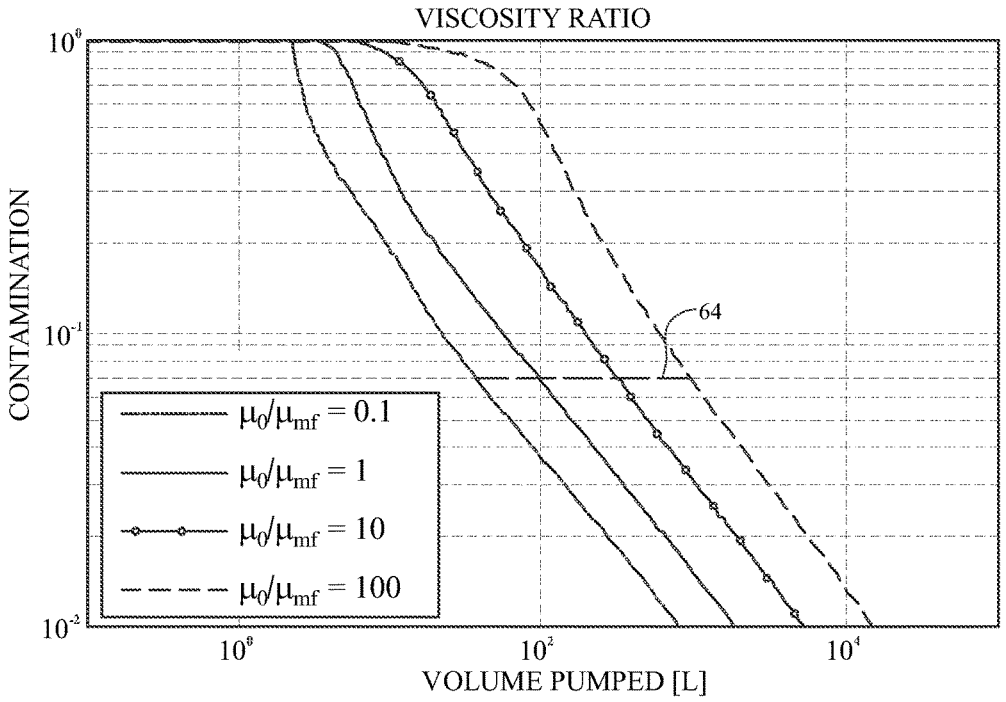
Figures 2, 6:
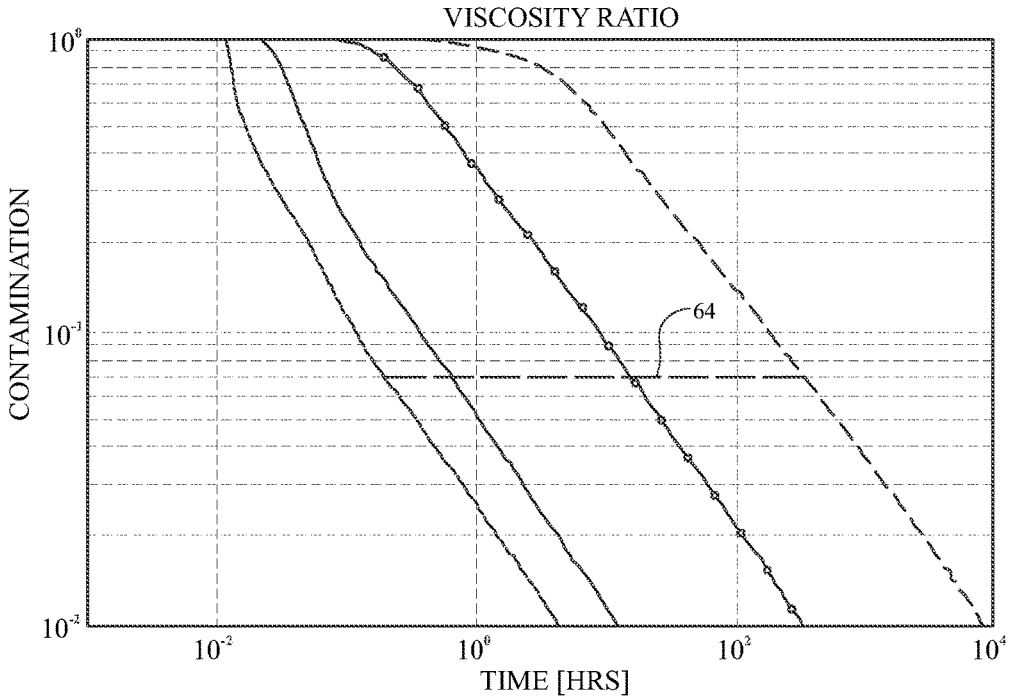
Figures 1, 7:
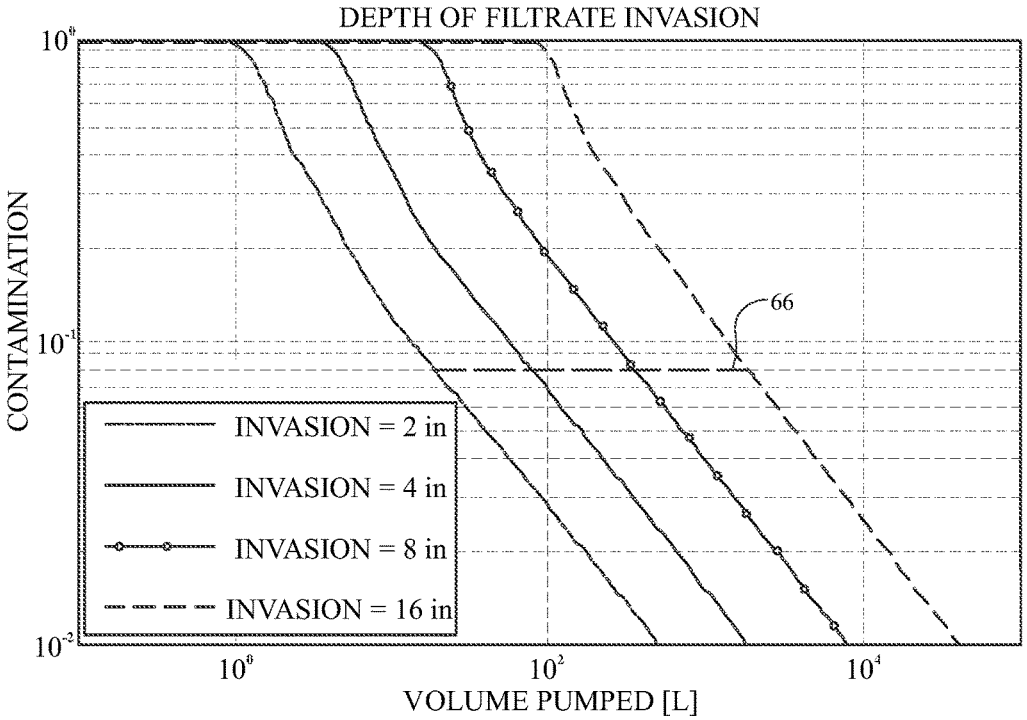
Figures 2, 7:
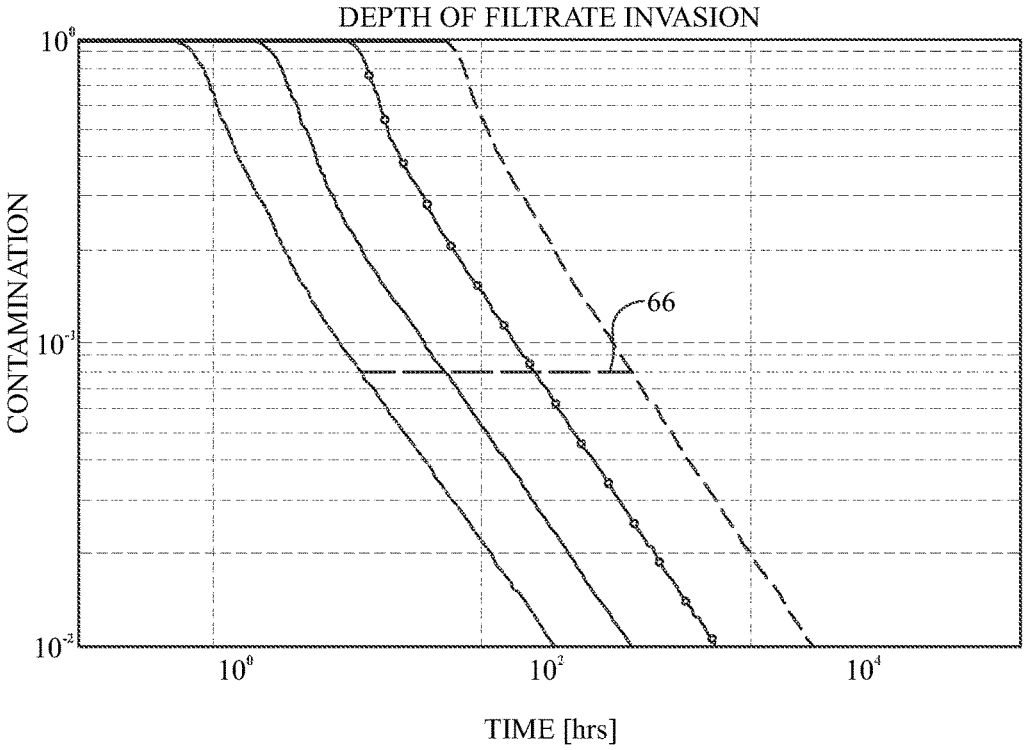

FIGS. 4-1 through 7-2 depict a sensitivity study for a clean-up performance with a radial probe having multiple circumferentially disposed inlets. The sensitivity study includes changes in absolute permeability (FIGS. 4-1 and 4-2), permeability anisotropy (FIGS. 5-1 and 5-2), viscosity ratio (FIGS. 6-1 and 6-2), and depth of filtrate invasion (FIGS. 7-1 and 7-2). Similar to FIG. 3, each graph plots the volume pumped (in liters) and the time (in hours) on a horizontal logarithmic scale versus the contamination ratio on a vertical logarithmic scale. In each case, the developed flow trend is proportional to $V^{-2/3}$, but the transition to the third flow regime 58 with developed flow exhibiting the two-thirds power law happens at a different time. Furthermore, as is visible in FIGS. 4-1 through 7-2, the three flow regimes are present irrespective of changes to the aforementioned conditions. The horizontal portion of the plot in the upper left of each graph reflects the first flow regime 54 in which only filtrate is produced. The plots each, thereafter, enter the second flow 56 regime. The second flow regime 56 manifests differently for each of the conditions simulated. The second flow regime 56 may therefore present challenges in identifying the moment developed flow establishes and the flow enters the third flow regime 58. However, the third flow regime 58 is proportional to $V^{-2/3}$ (or $t^{-2/3}$) in each case.

Figures 1, 4:
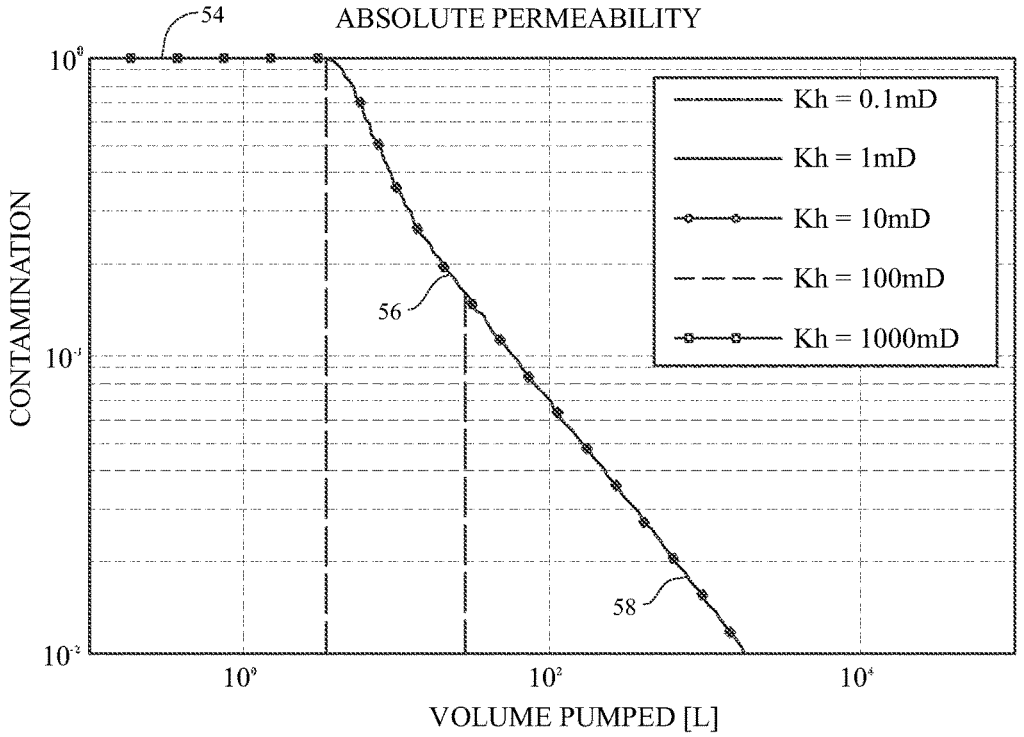
Figures 2, 4:
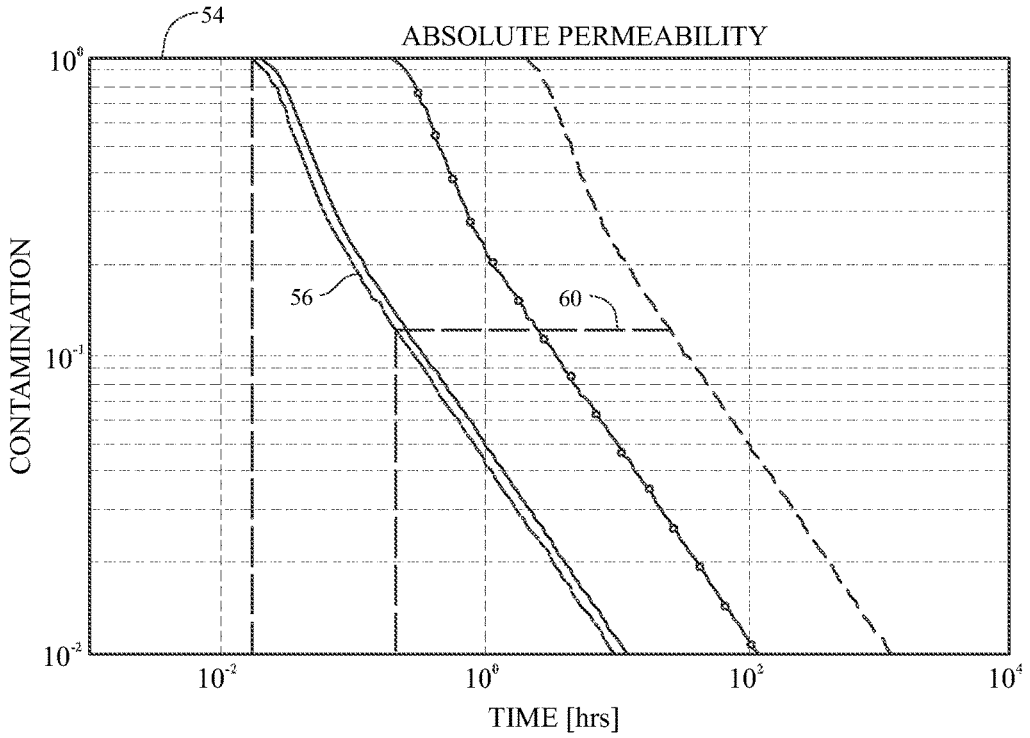

FIGS. 4-1 and 4-2 depict a sensitivity study for absolute permeability. FIG. 4-1 depicts a simulated contamination clean-up plot based on the volume of fluid pumped from the borehole and surrounding formation. Varying the absolute permeability of the formation alters the rate at which fluid moves through the formation, therefore, for all variations of the absolute permeability, the clean-up plot follows the same volume of fluid pumped. However, the time necessary to pump the same volume at each selected absolute permeability changes proportionately to the absolute permeability. This proportional increase in time is reflected in FIG. 4-2. The curves are similar, but each curve is spaced apart due to variations in the flow rate for each selected absolute permeability value. Developed flow establishes at approximately the same volume pumped 60 for each selected absolute permeability value, but involves proportionately more time as the absolute permeability decreases.

Figures 1, 5:
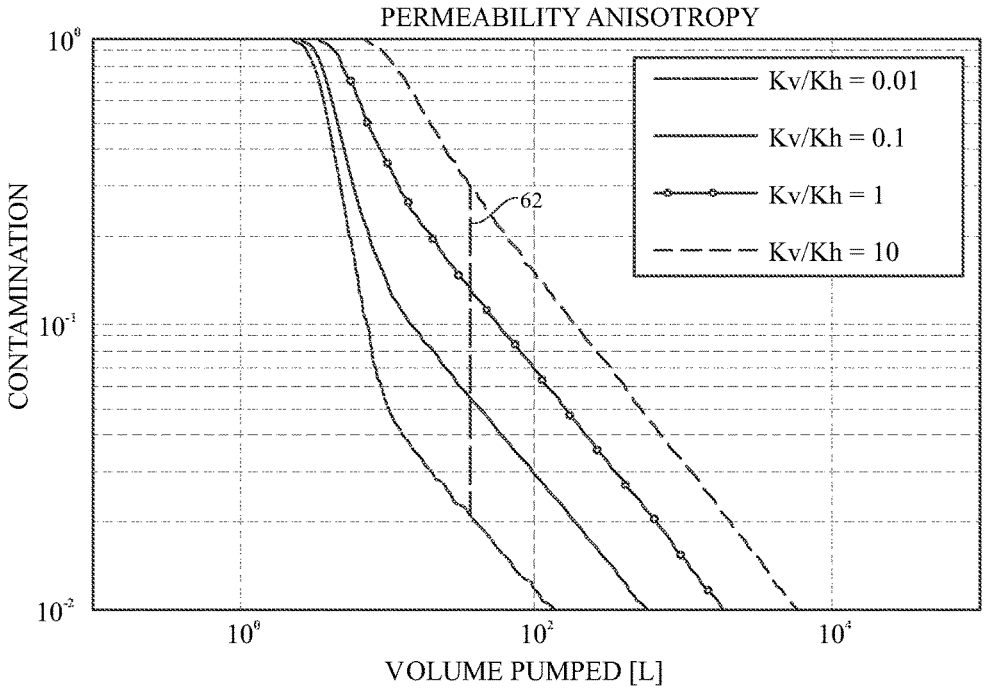
Figures 2, 5:
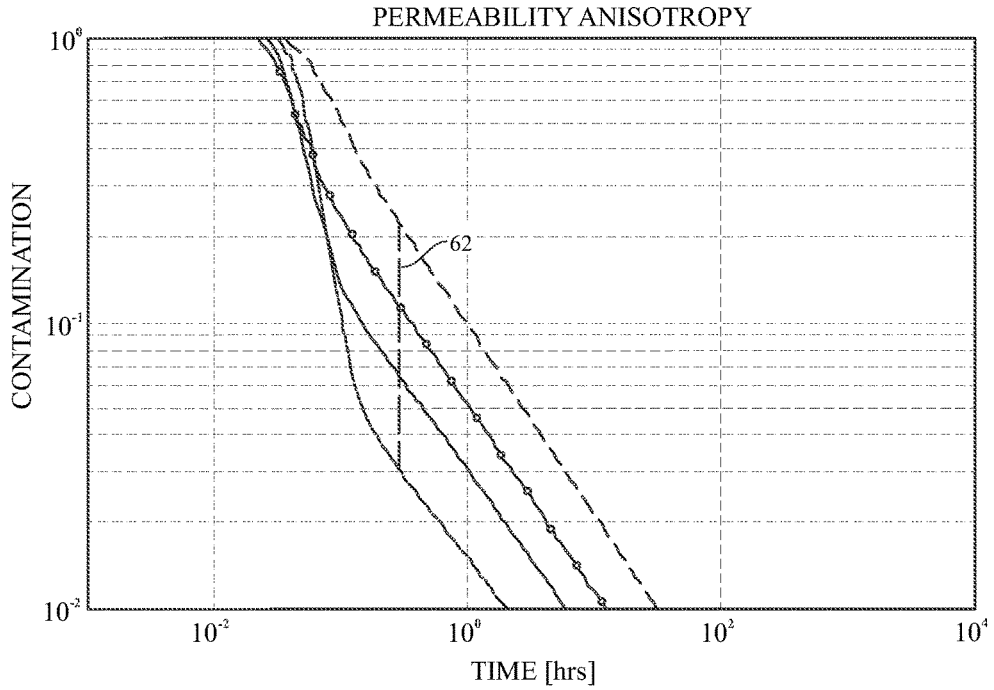

FIGS. 5-1 and 5-2 depict a sensitivity study for permeability anisotropy. Similarly to the absolute permeability sensitivity study of FIGS. 4-1 and 4-2, the developed third flow regime 58 establishes after an intermediate second flow regime 56 and is proportional to $t^{-2/3}$ (or $V^{-2/3}$). However, in contrast to FIGS. 4-1 and 4-2, the developed flow establishes at similar volumes pumped 62, which corresponds to a similar point in time 62 at each selected permeability anisotropy value. The second flow regime 56 correlates to the circumferential clean-up where filtrate is drawn from around the wellbore circumference at the level of the sampling device. The anisotropy of the permeability alters the path of the developed flow through the formation. The third flow regime 58, again, displays the same proportionality to $t^{-2/3}$ (or $V^{-2/3}$).

FIGS. 6-1 and 6-2 depict the clean-up rates of selected values for a viscosity ratio, or viscosity contrast, between the formation fluid and the drilling fluid. Flow in a mixture will favor a fluid with lower viscosity than a fluid with high viscosity. Therefore, the rate at which a contaminant is preferentially pumped from a system may change with changes in the viscosity ratio. The time and pump out volume both increase with an increase in the viscosity ratio, and, in contrast to altering the absolute permeability and permeability anisotropy, an increase in the viscosity ratios results in an increase time and pump out volume before establishing developed flow in the third flow regime 58. However, in each simulation, the transition point 64 at which each system establishes developed flow correlating to the −2/3 power law function occurs at a similar contamination, although the particular contamination ratio involves different volume or time to achieve.

Similarly, the depth of filtrate invasion also affects the time and pump out volume to establish developed flow. FIGS. 7-1 and 7-2 depict the simulated clean-up plots for selected filtrate invasion depths. The time and pump out volumes needed to reach transition point 66 and establish developed flow increase as the depth of the filtrate invasion into the surrounding formation increases. The clean-up plots of FIGS. 7-1 and 7-2 exhibit similar curves for each of the invasion depths. A significant difference between each of the clean-up plots is the time and pump out volume necessary to transition from the first flow regime to the second flow regime.

Both the depth of the filtrate invasion and the viscosity ratio between the formation fluid and drilling fluid alter the time or pump out volume at which developed flow establishes without significantly altering the percentage of the contaminant removed prior to the establishment of developed flow. In contrast, the absolute permeability alters the time at which the developed flow establishes, and the permeability anisotropy alters the percentage of the contaminant removed prior to establishing developed flow. In each situation, however, the clean-up rate of the third flow regime is proportional to $t^{-2/3}$ (or $V^{-2/3}$).

The power law of the third flow regime may allow the extrapolation of a property such as optical density, saturation pressure, gas-oil ratio, compressibility, conductivity, density, and the like. As can be seen in FIG. 3, the cleanup plot A establishes a linear behavior (e.g., on a log scale plot) in the third flow regime 58 at approximately 20 minutes. However, a full cleanup of the system would involve approximately 9 hours of cleanup to achieve a 1% contamination. Therefore, formation fluid properties may be calculated earlier in a cleanup process if a start of a third flow regime 58 can be properly identified and a cleanup plot properly modeled. For example, during cleanup, optical density may be selected as the measured property and optical density can be fit by the following power function:

$$OD=\alpha+\beta V^{\gamma} \tag{1}$$

where OD is the modeled optical density, V is the pump out volume (can be replaced by time t), and α, β and γ are three adjustable parameters. Additionally, γ has been empirically shown to range from about −1/3 to about −2/3 for developed flow, which may depend on the type of probe employed. In an embodiment, the value of γ is approximately −2/3 when employing a radial probe. The values of α and β are obtained by fitting the modeled data to the measured data. The values of α and β that may provide a correlation within a predetermined tolerance between the modeled and measured data are carried forward for the extrapolation. As the pump out volume increases, the value of $V^{-2/3}$ will begin to approach zero, therefore, at infinite pump out volume (or time), the modeled optical density (OD) will be that of the uncontaminated formation fluid optical density ($OD_{Oil}$). Therefore, the value of a, obtained from extrapolating volume to infinity, must be the value of the formation fluid optical density ($OD_{Oil}$).

The ratio of contaminant to clean formation fluid can be calculated using Beer-Lambert's mixing rule:

$$OD=\eta OD_{filtrate}+(1-\eta)OD_{Oil} \tag{2}$$

which may be rewritten as:

$$\eta=\frac{OD_{Oil}-OD}{OD_{Oil}-OD_{filtrate}} \tag{3}$$

in which OD can be either the optical density as measured by DFA or the optical density modeled by equation 1 as a function of volume or time. $OD_{filtrate}$ is a measured, calculated or known value. The filtrate optical density may be measured directly downhole, may be measured at surface conditions and corrected to attain the proper density at the appropriate depth, or calculated by other methods. Further, taking the log of Equation (1) and reordering the equation provides:

$$\text{Log}|OD-\alpha|=\text{Log}(\beta V^{\gamma}) \tag{4}$$

which may be rewritten as:

$$\text{Log}|OD-\alpha|=\gamma\ \text{Log}(V)+\text{Log}\ \beta \tag{5}$$

From equation (5), when the measured optical density behavior satisfies Equation (1), there is a linear relation between the Log of the absolute value of $OD\beta OD_{Oil}$ and the Log of V, where OD is the measured optical density, $OD_{Oil}$ is the optical density extrapolated from fitting equation 1 to optical density data (defining $\alpha=OD_{Oil}$) and V is the pump out volume. In other words, the flow has entered the developed flow of the third flow regime when the rate of change of the log of the difference between the measured optical density and the formation fluid optical density is linearly correlated to the rate of change of the product of the exponent and the log of the pump out volume. As stated earlier, as the pump out volume increases, the measured optical density may approach that of the pure formation fluid.

When the plot of the Log of the absolute value of $OD-OD_{Oil}$ versus the Log of V exhibits linear behavior, the measured optical density data satisfies constant power law behavior. When the measured data does not form a straight line, the power law is changing. Therefore, the clean-up is still in the second flow regime and has not yet established developed flow.

Figure 8:
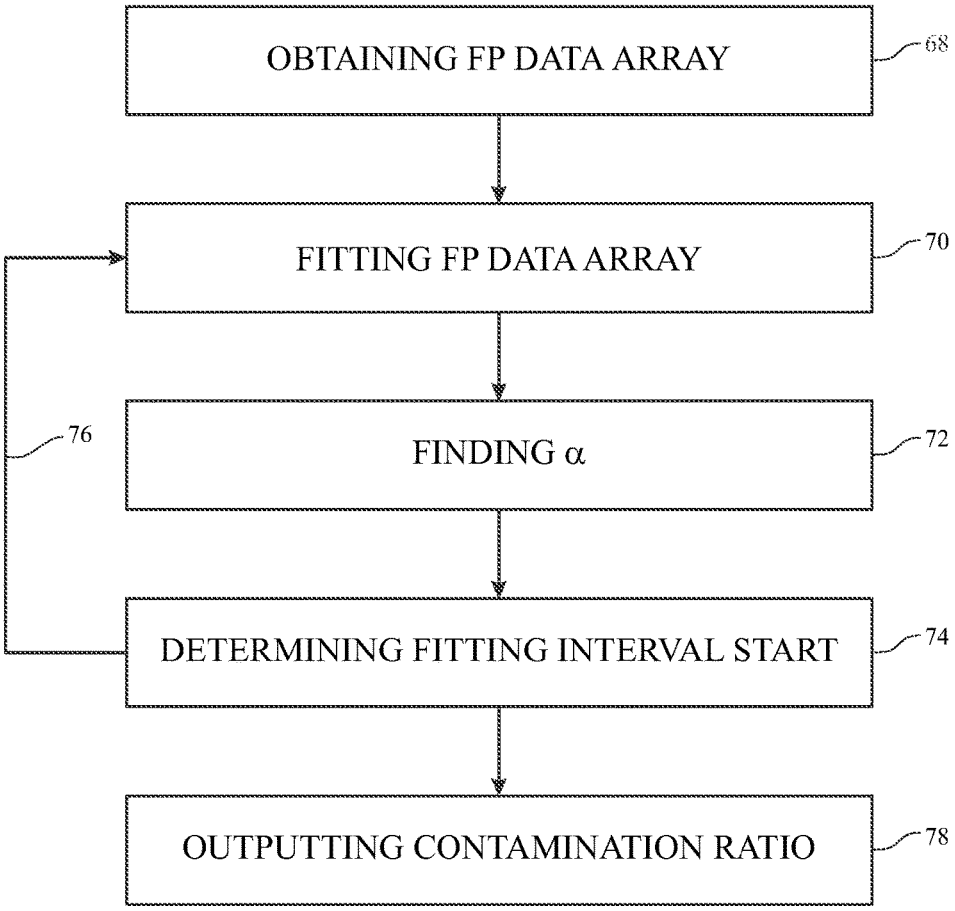
FIG. 8 is a flowchart depicting a method, in accordance with one or more embodiments of the present disclosure.
Figure 9:
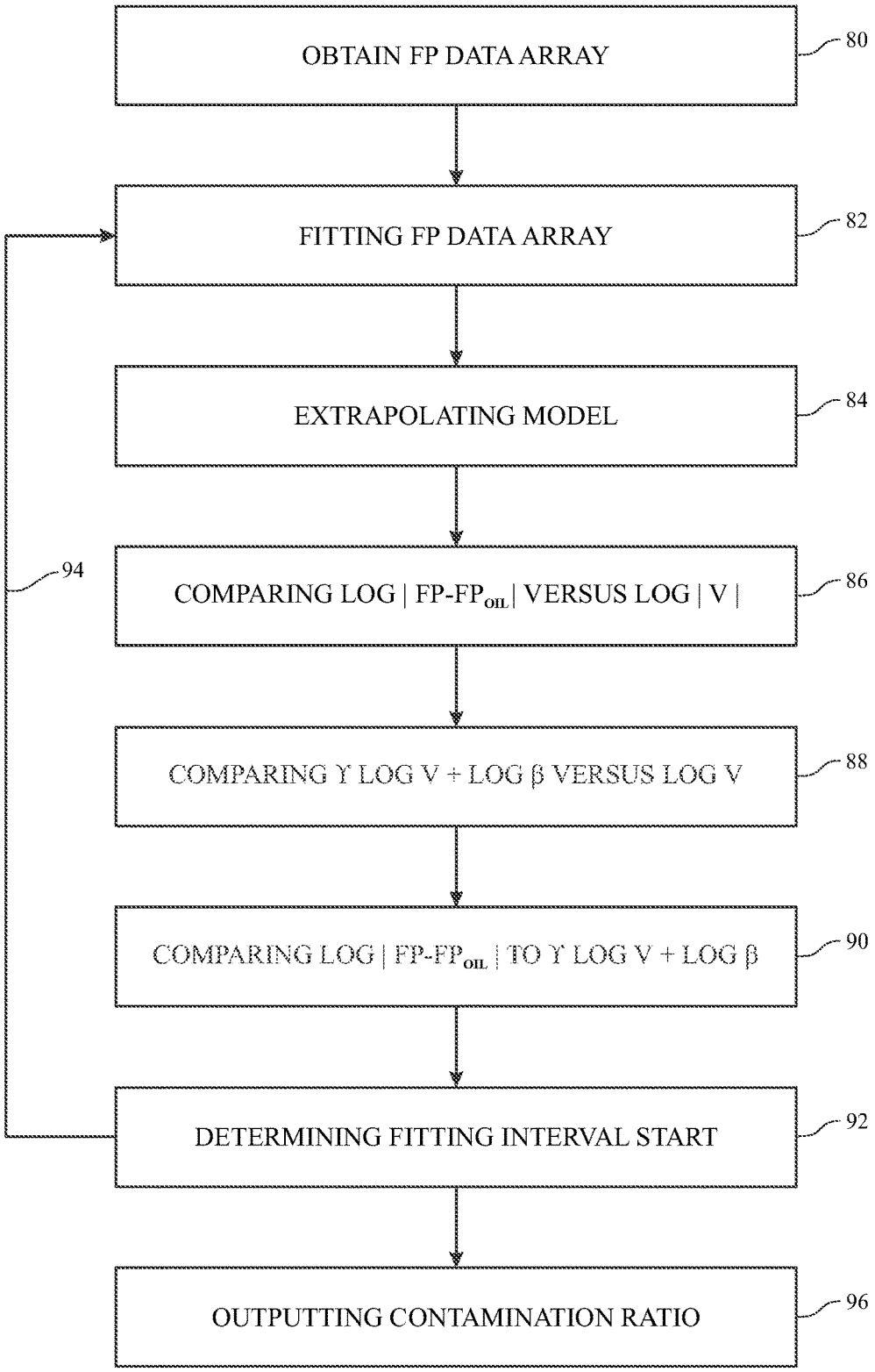
FIG. 9 is a flowchart depicting a another method, in accordance with one or more embodiments of the present disclosure.
Figure 10:
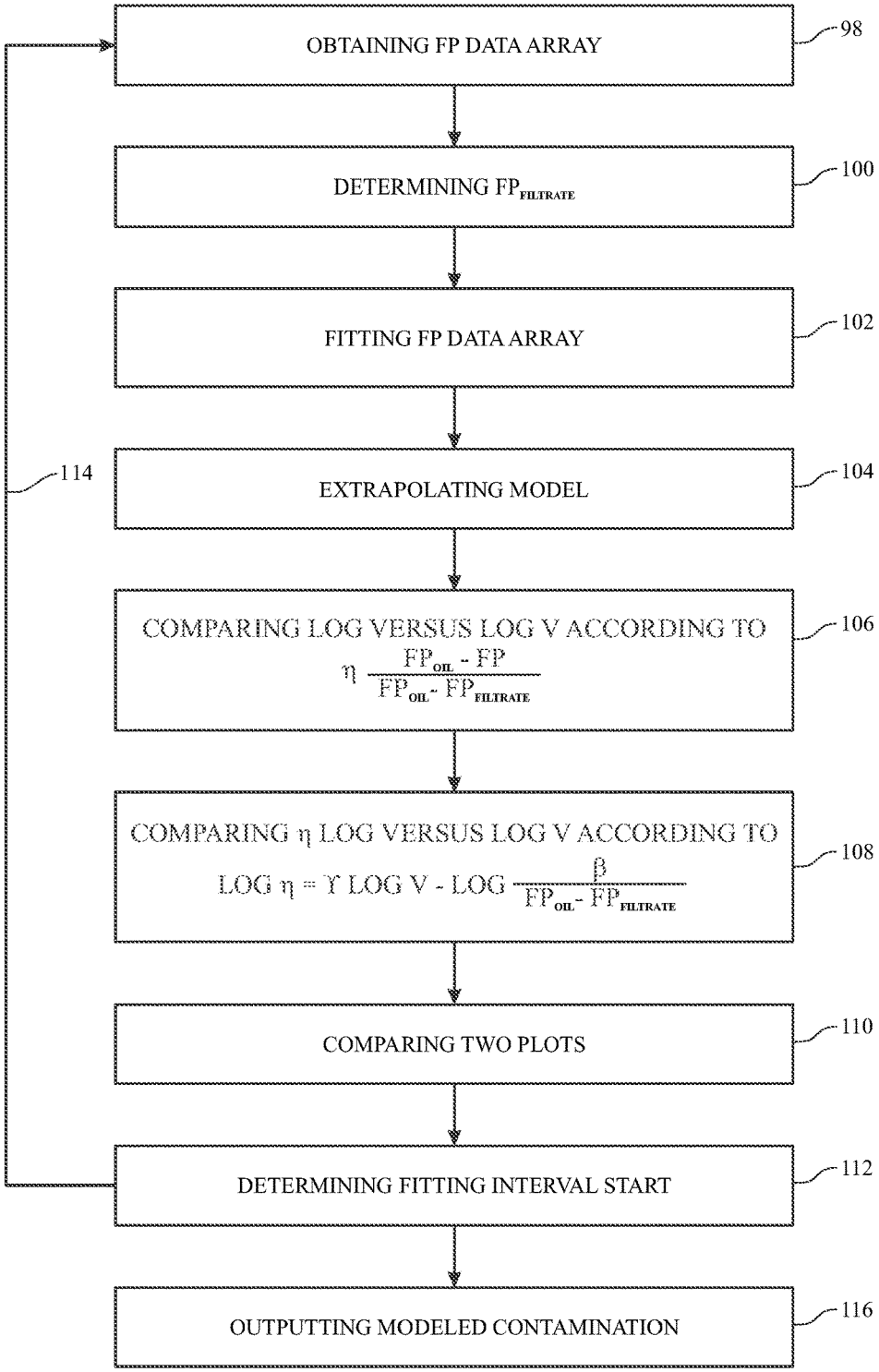
FIG. 10 is a flowchart depicting a yet another method, in accordance with one or more embodiments of the present disclosure.

In view of the systems and architectures described above, methodologies that may be implemented in accordance with the disclosed subject matter will be better appreciated with reference to the flow charts of FIGS. 8, 9, and 10. For purposes of simplicity of explanation, the methodologies are shown and described as a series of blocks. However, it should be understood and appreciated that the claimed subject matter is not limited by the order of the blocks, as some blocks may occur in different orders and/or concurrently with other blocks from what is depicted and described herein. Moreover, not all illustrated blocks may be used to implement the methodologies described hereinafter.

Accordingly, the present disclosure includes a method, depicted in FIG. 8, for identifying the establishment of developed flow, fitting the appropriate power law function, and extrapolating measured properties to provide estimates of clean fluid properties. In an embodiment, the method may include obtaining a measured data array including at least a sample fluid parameter (FP) (e.g. optical density, gas-oil ratio, conductivity, density, compressibility, and other properties measurable through DFA as discussed above in connection with FIG. 1) and a durational value (D) (68) and fitting a model to the measured data array, the power law function having a predefined exponent value (70). The durational value (D) may be a time value (t), a volume pumped (V), or other parameter appropriate for measuring the duration of the cleanup. The model may then be extrapolated to obtain a value of a constant, such as $\alpha$ (72). The value of the constant may be applied to the power law function. Applying $\alpha$ to the power law function when the durational value equals infinity results in $\alpha$ being equal to the fluid parameter of the formation fluid, such as $FP_{Oil}$ and in circumstances when the fluid parameter is optical density $\alpha$ equals $OD_{Oil}$. $\alpha$ may also be applied to the power law function to obtain a value of $\beta$. When values for each adjustable parameter are known, the power law function and measured data array may be used to determine a fitting interval start (74) that defines the start of the third flow regime. The fitting interval start may be tested and confirmed or recalculated, such as by repeating the foregoing acts (76). The contamination ratio may then be output (78), such as with Beer-Lambert's mixing law shown in equation 3. In some embodiments the contamination ratio is plotted, such as on a graph or presented on a display.

In another embodiment, as depicted in FIG. 9, a method is provided for identifying the establishment of developed flow, fitting the appropriate power law function, and extrapolating measured properties to provide estimates of clean formation fluid properties. More specifically, a method for extrapolating uncontaminated formation fluid property values from property values measured from a contaminated sample fluid may include obtaining a measured data array including at least a sample fluid parameter (FP) and a durational value (D) (80). The sample fluid parameters (FP) of the measured data array may include optical density, gas-oil ratio, conductivity, density, compressibility, and other properties measurable through DFA as discussed above in connection with FIG. 1. A model may be fitted to the measured data array where the model is defined by a power law function proportional to $V^{-2/3}$ (or, alternatively, $t^{-2/3}$) (82). Once the model is fitted to the measured data array, the model is extrapolated to infinite volume pumped out to obtain a value of the formation fluid parameter ($FP_{Oil}$) (84).

Using the formation fluid value ($FP_{Oil}$) obtained from the previous fitting, $\text{Log}|FP-FP_{Oil}|$ versus Log V may be plotted (86). Thereafter, ($\gamma$ Log V+Log $\beta$), where $\gamma=-2/3$, versus Log V may be plotted on the same graph as $\text{Log}|FP-FP_{Oil}|$ versus Log V (88). $\text{Log}|FP-FP_{Oil}|$ may then be compared to ($\gamma$ Log V+Log $\beta$) (90). While the present disclosure refers to the comparison of values or equations by comparing plots of each, it should be understood that the comparison of values or equations may be accomplished by calculation, plotting, or any suitable mechanism. Furthermore, the term "plotting" as used herein is used broadly to refer to the comparison of data arrays and models whether displayed graphically or not. A fitting interval start may be determined by determining when the values of $\text{Log}|FP-FP_{Oil}|$ and ($\gamma$ Log V+Log $\beta$) overlay one another (92). As used herein, the term "overlay" means equal or within a predetermined tolerance. The foregoing acts may be repeated to ensure that the fitting interval start coincides with the point determined in the prior act (94). The contamination (according to $\eta=(FP_{Oil}-FP)/(FP_{Oil}-FP_{filtrate})$) may then be plotted (96). In some embodiments the contamination ratio is plotted, such as on a graph or presented on a display.

In addition to the foregoing, criteria may be added to aid in determining whether developed flow has been established. In one embodiment, when the sampling is conducted with a sampling tool having multiple ports, a start of the third flow regime may be after an inflection point has occurred in the plot when considered on log-log scales. In another embodiment, a start of the third flow regime may be after contamination is less than about 30%. Furthermore, the robustness of the fit may be tested by changing the fitting interval start volume and ensuring $\alpha$ remains within a predetermined tolerance. In an embodiment, the robustness of the fit may be tested by increasing the fitting interval start volume. The sensitivity of the fit to a change in the fitting start volume will decrease, as the quality of the fit improves. For example, a correct fit may be insensitive to changes in fitting interval start volume. In an embodiment, $\alpha$ may change by less than about 5% and remain in the predetermined tolerance. In another embodiment, $\alpha$ may change by less than about 1% and remain in the predetermined tolerance. In yet another embodiment, $\alpha$ may change by less than about 0.5% and remain in the predetermined tolerance.

In some embodiments, developed flow may be determined and end conditions of the fluid clean-up may be calculated by combining equations (1) and (3). Doing so provides:

$$\eta = \frac{OD_{Oil} - \alpha - \beta V^{\gamma}}{OD_{Oil} - OD_{Filtrate}} \tag{6}$$

Equation 6 describes the contamination ratio $\eta$ by applying Beer-Lambert's mixing law and defining the modeled optical density at any given pump out volume in terms of the known power law function described in Equation 1. Furthermore, when the extrapolated pump out volume approaches infinite volume the fluid is uncontaminated and $\alpha=OD_{Oil}$, therefore, Equation 6 further reduces to:

$$\eta = \frac{-\beta V^{\gamma}}{OD_{Oil} - OD_{filtrate}} \tag{7}$$

where $\gamma=-2/3$.

Upon taking the Log of Equation (7), the equation may be defined as $$\mathrm{Log}\eta = -\mathrm{Log}(V^{\gamma}) - \mathrm{Log}\frac{\beta}{OD_{Oil} - OD_{filtrate}} \tag{8}$$

and finally, $$\mathrm{Log}\eta = -\gamma\mathrm{Log}V - \mathrm{Log}\frac{\beta}{OD_{Oil} - OD_{filtrate}}. \tag{9}$$

Equation 9 demonstrates an additional method to produce a linear relationship between Log|η| (the Log of the contamination ratio of drilling fluid to formation fluid) and Log V (the Log of a volume pumped), where the value of γ, again, becomes the slope of the logarithmic relationship.

Accordingly, the present disclosure includes another method, shown in FIG. 10, for determining and plotting a linear relationship between the Log of a volume pumped and the Log of the contamination ratio of drilling fluid to formation fluid. As shown in FIG. 10, the method may include obtaining a measured data array including at least a sample fluid parameter (FP) and a durational value (D) (98). As noted elsewhere herein, the measured value may include optical density, saturation pressure, gas-oil ratio, compressibility, conductivity, density, and the like. The fluid parameter of the filtrate $FP_{filtrate}$ is also determined (100). A model defined by a power law function proportional to $V^{-2/3}$ (or, alternatively, $t^{-2/3}$) is fitted to the measured data array (102). Thereafter, the model is extrapolated to infinite volume pumped out to obtain a value of the formation fluid ($FP_{Oil}$) (104).

A first plot of Log|η| versus Log V using equation 3, where OD is equal to the measured optical density, is plotted a on a graph (106). Likewise, a second plot of Log|η| versus Log V according to equation 9 using the same $OD_{Oil}$ and $OD_{filtrate}$ is plotted on the same graph (108). A comparison is made between the first and second plots on the graph (110) in order to determine whether the first and second plots overlay (112). The point where the curves overlay may coincide with the start of a logarithmic trend of the contamination calculated from measured data. The previous acts may be repeated to ensure that the fitting interval start coincides with the point determined in the prior act (114). The contamination (according to $\eta=(FP_{Oil}-FP)/(FP_{Oil}-FP_{filtrate})$) may then be plotted on a linear scale (116).

In addition to the foregoing, criteria may be added to aid in determining whether developed flow has been established. In one embodiment, when the sampling is conducted with a sampling tool having multiple ports, a start of the third flow regime may be after an inflection point has occurred in the plot when considered on log-log scales. In another embodiment, a start of the third flow regime may be after contamination is less than about 30%. Furthermore, the robustness of the fit may be tested by changing the fitting interval start volume and ensuring α remains within a predetermined tolerance. In an embodiment, the robustness of the fit may be tested by increasing the fitting interval start volume. The sensitivity of the fit to a change in the fitting start volume will decrease as the quality of the fit improves. For example, a correct fit may be insensitive to changes in fitting interval start volume. In an embodiment, α may change by less than about 5% and remain in the predetermined tolerance. In another embodiment, α may change by less than about 1% and remain in the predetermined tolerance. In yet another embodiment, α may change by less than about 0.5% and remain in the predetermined tolerance.

Figure 11:
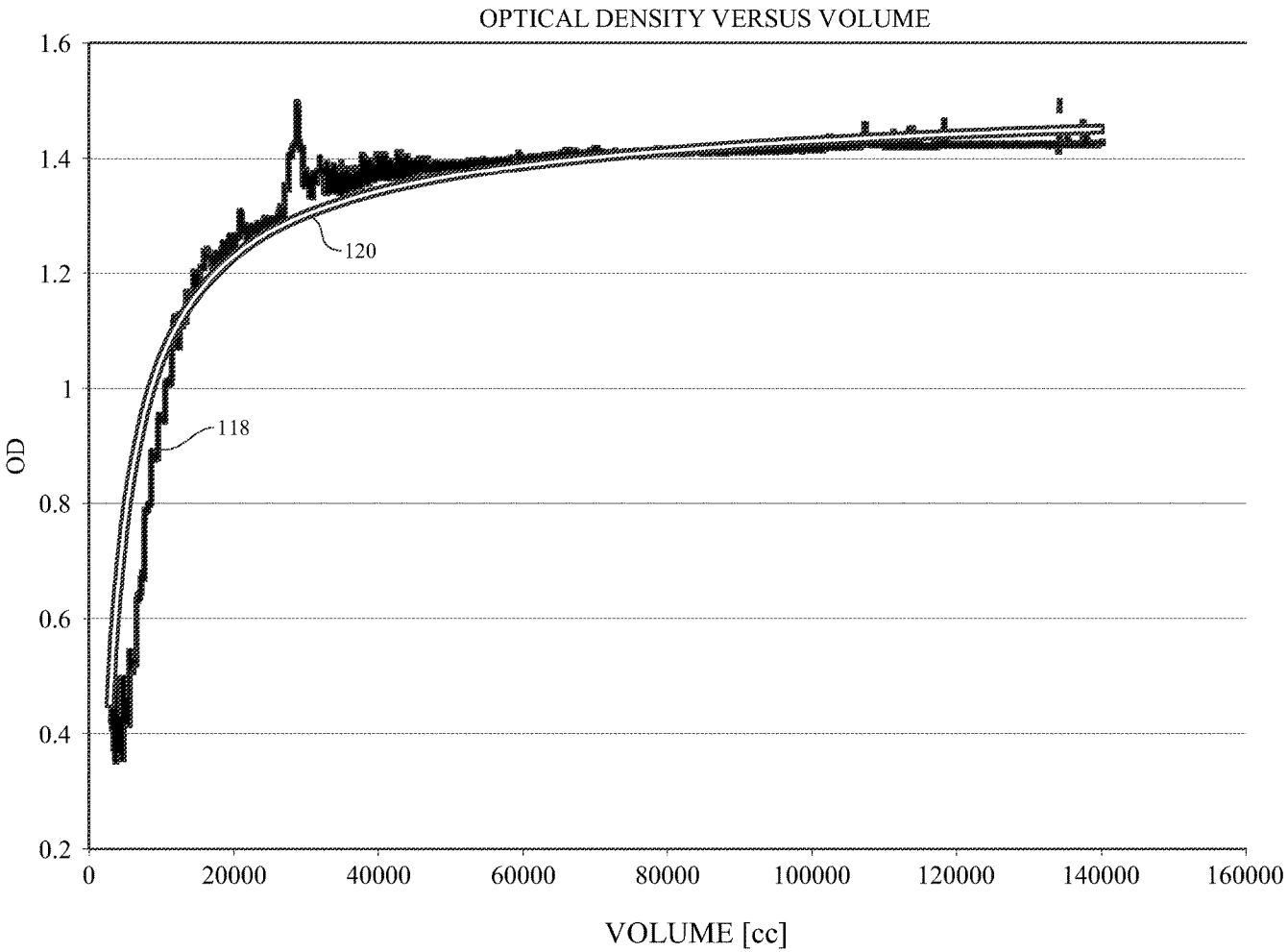
FIG. 11 depicts a graph showing an increase in optical density as measured during well cleanup, in accordance with one or more embodiments of the present disclosure.
Figure 12:
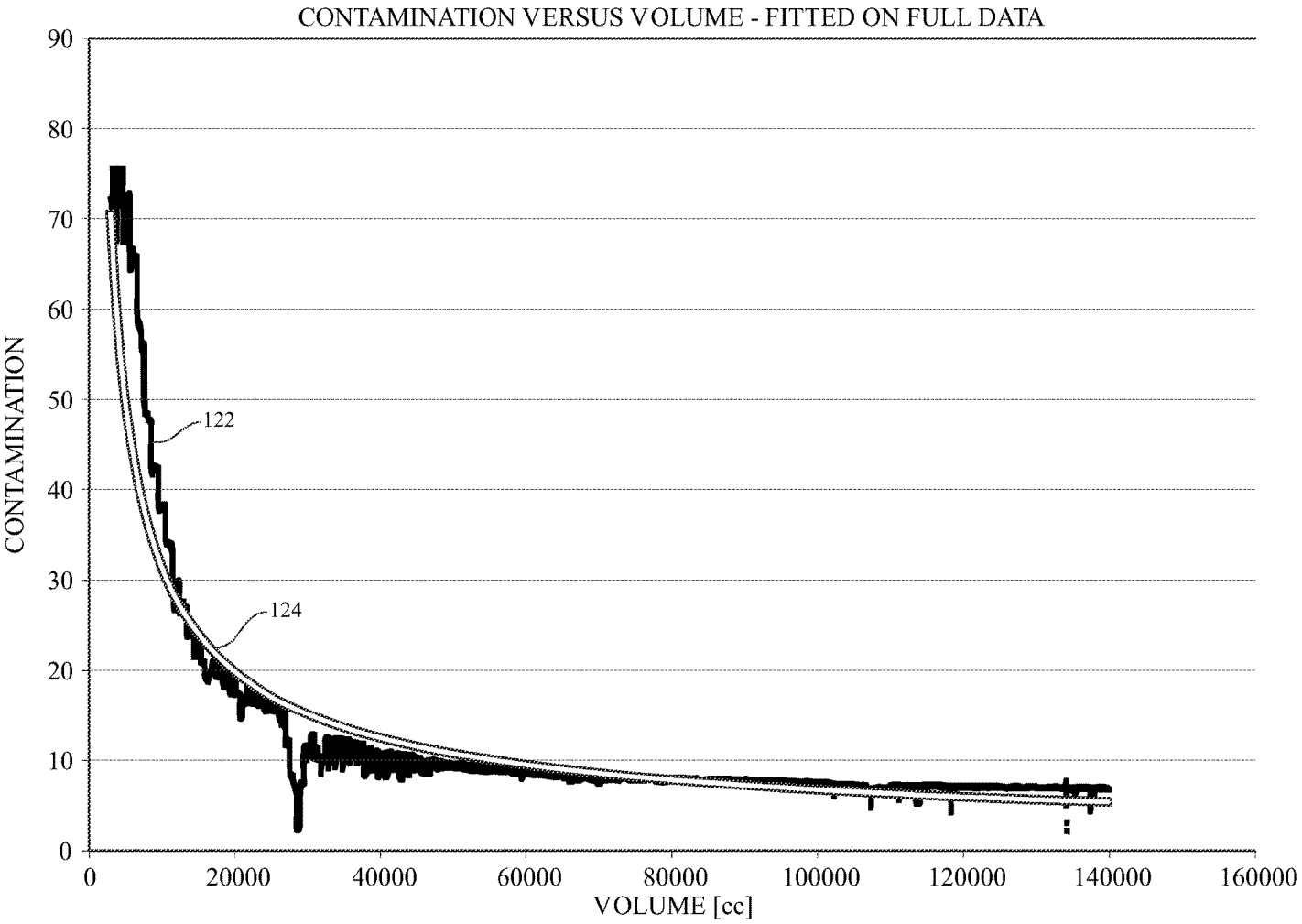
FIG. 12 depicts a graph reflecting an improper fitting of the data of FIG. 11 based on a full cleanup plot, in accordance with one or more embodiments of the present disclosure.
Figure 13:
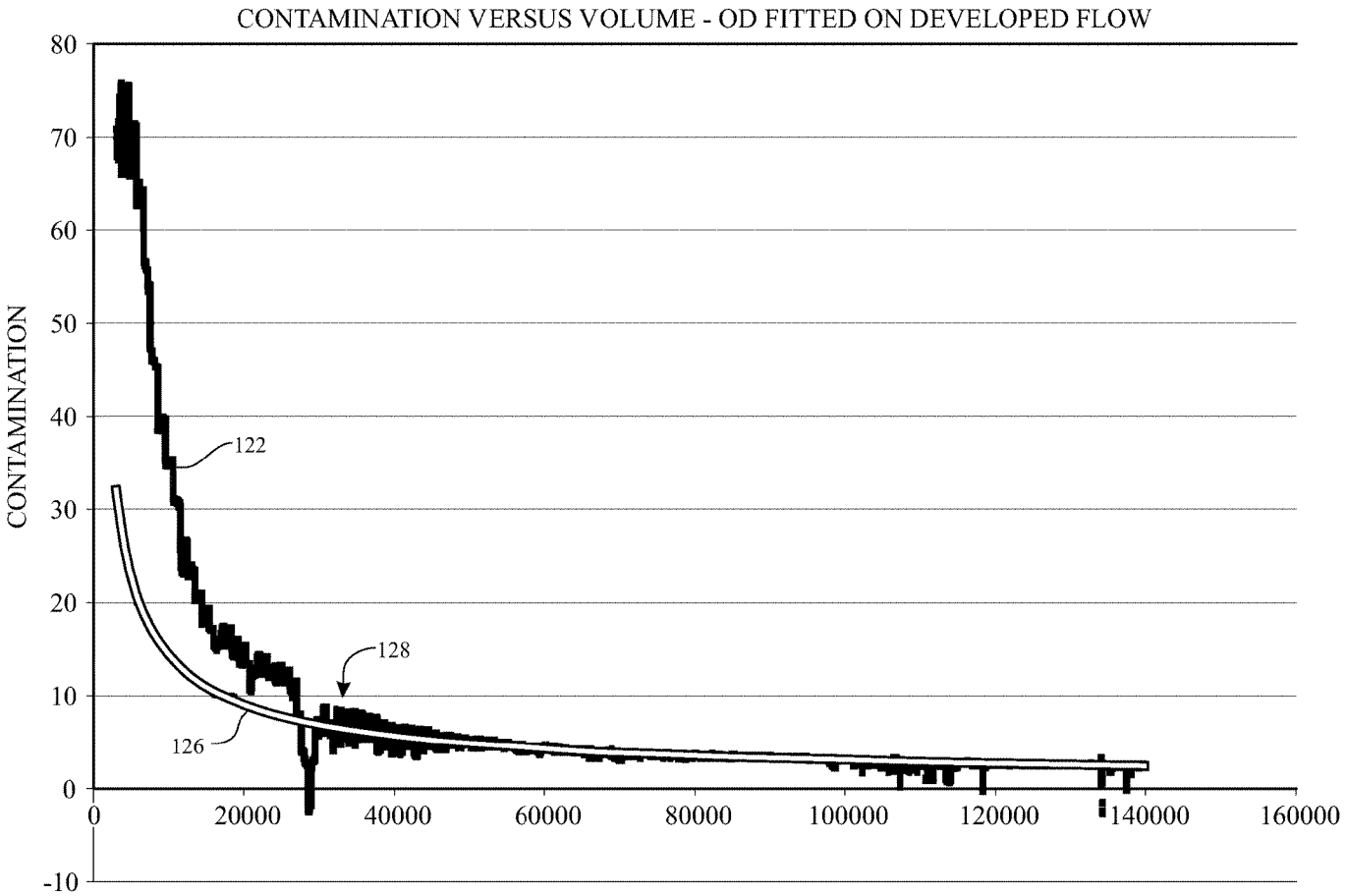
FIG. 13 depicts a graph reflecting a proper fitting of the data from FIG. 11 based on developed flow, in accordance with one or more embodiments of the present disclosure.

Such logarithmic behavior in a third flow regime during cleanup may be seen, for example, in FIGS. 11-15. FIG. 11 shows a plot of optical density data interval 118 collected during well cleanup. Attempting to fit a single logarithmic curve to the entire data interval 118 yields a poorly fit curve 120. Similarly, when the optical density is used to plot the contamination of the system versus volume pumped, as shown in FIG. 12, the contamination plot 122 reflects the previously described relationship between the optical density and the contamination. Attempting to fit a single logarithmic curve to the entire plot 122 yields a poorly fit curve 124. FIG. 13 shows a properly modeled curve 126 fit to the contamination plot 122 in accordance with the methods disclosed herein. Notably, the fitting start is not the start of the data interval 122, but rather at the start of the developed flow regime 128.

Figure 14:
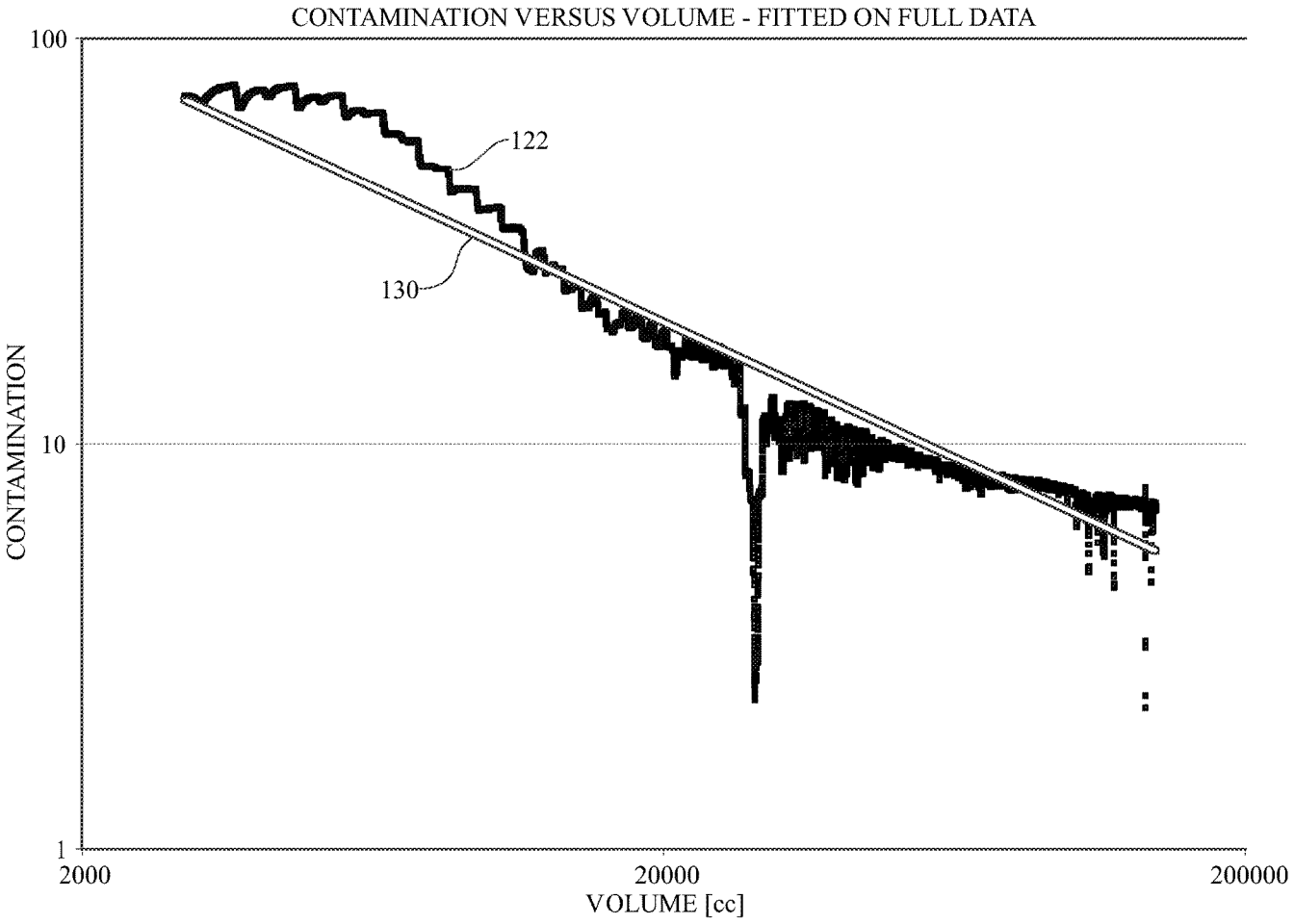
FIG. 14 depicts the data and improper fitting of FIG. 12 on a logarithmic scale, in accordance with one or more embodiments of the present disclosure.
Figure 15:
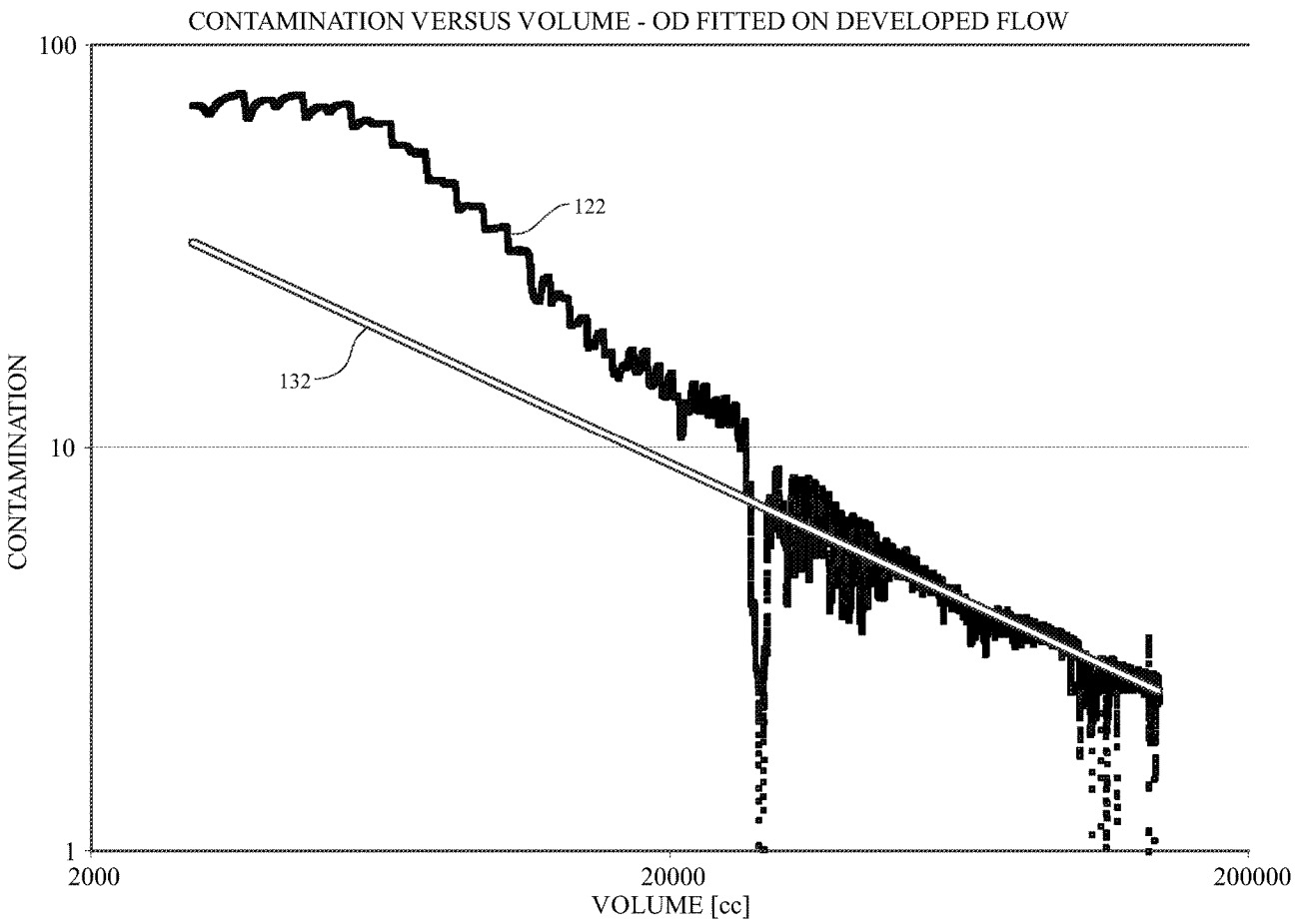
FIG. 15 depicts the data and proper fitting of FIG. 14 on a logarithmic scale, in accordance with one or more embodiments of the present disclosure.

Similarly, FIG. 14 shows a contamination plot 122 and a poorly fit line 130 when the optical density is used to plot the contamination of the system versus volume pumped on a logarithmic scale. The contamination plot reflects the relationship between the optical density and the contamination. On the logarithmic scale, the third flow regime will exhibit linear behavior. Attempting to fit a single logarithmic line to the entire plot 122, again, yields a poorly fit line 130. FIG. 15 shows a properly modeled line 132 fit to the contamination plot 122 in accordance with the methods disclosed herein. That is, the properly modeled line 132 is fit the developed flow regime portion of the plot 122.

Embodiments described herein may be implemented on various types of computing systems. These computing systems are now increasingly taking a wide variety of forms. Computing systems may, for example, be handheld devices, appliances, laptop computers, desktop computers, mainframes, distributed computing systems, or even devices that have not conventionally been considered a computing system. In this description and in the claims, the term "computing system" is defined broadly as including any device or system that includes at least one physical and tangible processor, and a physical and tangible memory capable of having thereon computer-executable instructions that may be executed by the processor. A computing system may be distributed over a network environment and may include multiple constituent computing systems.

As used herein, the term "executable module" or "executable component" can refer to software objects, routings, or methods that may be executed on the computing system. The different components, modules, engines, and services described herein may be implemented as objects or processes that execute on the computing system (e.g., as separate threads).

Figure 16:
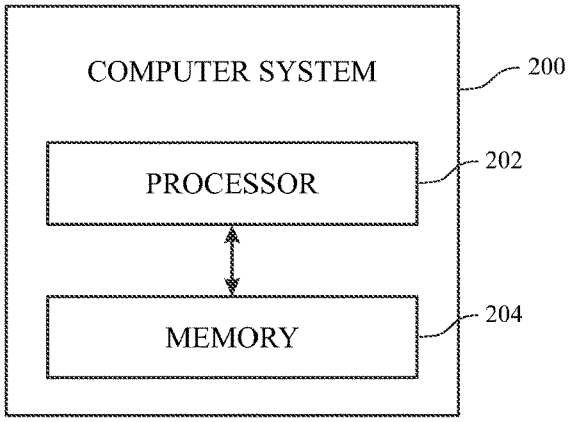
FIG. 16 depicts a computer system that performs methods, in accordance with the present disclosure.

As illustrated in FIG. 16, a computing system 200 includes at least one processing unit 202 and memory 204. The memory 204 may include one or more tangible, non-transitory, machine readable media collectively storing one or more sets of instructions for operating the sampling tool 12 and estimating an amount of mud filtrate in the native reservoir fluid. The memory 204 may store mixing rules and algorithms associated with the native reservoir fluid, the drilling mud, and combinations thereof to facilitate estimating an amount of the drilling mud in the formation fluid. The data computing system 200 may use the fluid property and composition information of the generated by the sampling tool 12 to estimate an amount of the mud filtrate in the formation fluid.

The processing unit 202 may execute instructions stored in the memory 204. For example, the instructions may cause the processor to quantify the amount of mud filtrate contamination in the native reservoir fluid, and estimate fluid and compositional parameters of the native reservoir fluid and the pure mud filtrate (e.g., pure oil-based mud filtrate). As such, the memory 204 of the computing system 200 may be any suitable article of manufacture that can store the instructions. By way of example, the memory 204 may be ROM memory, random-access memory (RAM), flash memory, an optical storage medium, or a hard disk drive.

In certain embodiments, the computing system 200 may select a model according to the configuration of the sampling tool 12 rather than the flow regimes 54, 56, 58. For example, as discussed above, with reference to FIG. 1, the sampling tool 12 may be a focused sampling tool. Unlike unfocused sampling tools, the flow regimes 54, 56, 58 may not be observed in focused sampling applications. Therefore, the exponent γ in the power-law functions generally used to determine endpoint values for pure fluids (e.g., native formation fluid and/or pure drilling mud filtrate) may need to be adjusted to match the cleanup data. For example, the exponent γ may be determined by fitting the clean up data to the power model function. As such, the exponent γ may be treated as an adjustable parameter for determining endpoint values of the native (e.g., virgin) formation fluid and pure oil-based mud (OBM) filtrate in focused sampling applications.

As discussed above, the endpoint values may be sensitive to the exponent γ and fitting intervals (e.g., the power-law models used to fit the flow regimes 54, 56, 58 have a different exponent γ). Therefore, the exponent γ for focused sampling applications is determined by fitting the clean up data to the model. This may result in an inaccurate exponent γ and pure fluid endpoint values in focused sampling. According, it may be difficult to assess the oil-based mud (OBM) filtrate contamination levels of the formation fluid.

It is believed that regression models such as, but not limited to, exponential functions, logistic functions, sigmoid family functions, and in certain embodiments, simplified power-law models that do not include the exponent γ may be used to accurately determine the endpoint values for the native formation fluid and/or the pure OBM filtrate, thereby increasing the accuracy of the OBM filtrate contamination level in the formation fluid. As described in further detail below, the regression models may be derived from a relationship between a power-law function and a spherical radial parameter. The regression models include geometric fitting models that may match fluid property data measured by a focused sampling tool (e.g., the sampling tool 12) with greater accuracy compared to power-law functions (e.g., EQ. 1) generally used for unfocused sampling applications. Although the embodiments discussed below are in the context of oil-base mud filtrate contamination, it should be noted that presently contemplated embodiments are also applicable to water-based mud filtrate contamination.

Figure 17:
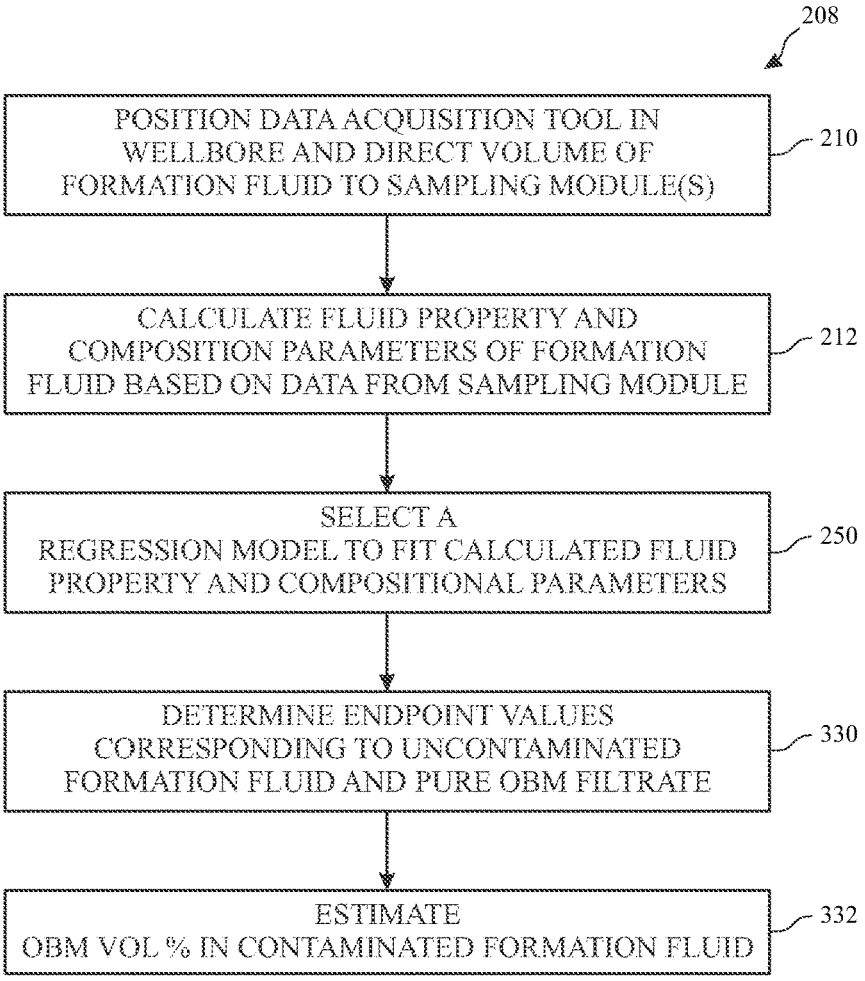
FIG. 17 is a flowchart depicting a method of determining mud contamination for focused sampling applications, in accordance with one or more embodiments of the present disclosure.

FIG. 17 illustrates a flowchart 208 of a method for monitoring the OBM contamination level in the formation fluid using a focused sampling tool. In accordance with the illustrated flowchart 208, the sampling tool 12 (e.g., the downhole acquisition tool) is positioned at a desired depth within the wellbore and a volume of the formation fluid is directed to the sampling modules (e.g., modules 20, 22, 24) for analysis (block 210). For example, the sampling tool 12 is lowered into the wellbore, as discussed above with reference to FIG. 1, such that the probe module 20 is within a fluid sampling region of interest. The probe module 20 faces toward the geological formation to enable a flow of the formation fluid through the flowline toward the fluid analysis module 22 and sampling module 28.

While in the sampling tool 12, multiple sensors in the fluid analysis module 22 detect and transmit fluid and compositional parameters of the formation fluid such as, but not limited to, GOR, density (ρ), composition ($m_j$), optical density (OD), shrinkage factor (b), and any other suitable parameter of the formation fluid to the computing system 200. The computing system 200 applies one or more algorithms to calculate the fluid property and the composition (e.g., amount of $C_{1-6+}$) of the formation fluid 52 based on the data from the modules 22, 28 (block 212). For example, the computing system 200 may calculate the fluid and the compositional parameters based on mixing rule algorithms derived for binary fluids, such as the oil-based mud (OBM) contaminated formation fluid.

For the purpose of the following discussions, it is assumed that an oil-based mud (OBM) contaminated formation fluid is in a single-phase (e.g., liquid or gas) at downhole conditions due to the miscibility of the OBM and the hydrocarbon (e.g., oil and/or gas) present in the native formation fluid. Additionally, it is assumed that OBM filtrate is present in flashed stock-tank oil (STO) phase and is not present in flashed gas phase when the native formation fluid is flashed from downhole conditions to standard temperature and pressure conditions (e.g., surface conditions of approximately 0.1 megapascals (MPa) and approximately 15° C.). Accordingly, the following single phase mixing rules are defined for optical density (OD), EQ. 10; shrinkage factor (b), EQ. 11; f-function (e.g., auxiliary function for modified GOR), EQ. 12; density (ρ), EQ. 13; and composition mass fraction ($m_j$), EQ. 14. The aforementioned assumptions are provided to simplify the discussion below. The present disclosure may be adjusted accordingly to accommodate different assumptions.

$$OD_i = v_{obm} OD_{obmi} + (1 - v_{obm}) OD_{0i} \tag{10}$$

$$b = v_{obm} b_{obm} + (1 - v_{obm}) b_0 \tag{11}$$

$$f = v_{obm} f_{obm} (1 - v_{obm}) f_0 \tag{12}$$

$$p = v_{obm} \rho_{obm} + (1 - v_{obm}) \rho_0 \tag{13}$$

$$m_j = w_{obm} m_{obmj} + (1 - w_{obm}) m_{0j} \tag{14}$$

where $v_{obm}$ and $w_{obm}$ are the OBM filtrate contamination level of the formation fluid in volume fraction and weight fraction based on live fluid, respectively. The subscripts 0, obm, i, and j represent the uncontaminated formation fluid (e.g., the native formation fluid), pure OBM filtrate, optical channel i, and component j in the formation fluid, respectively. As should be noted, j can refer to any component measured downhole. By way of example, $m_j$ may be the mass fraction $CO_2$, $C_1$, $C_2$, $C_3$-$C_5$, $C_{6+}$ (e.g., hexanes, heptanes, octanes, asphaltenes, etc.), or any other downhole component of interest in the formation fluid.

Once the fluid property data for the formation fluid is measured, the computing system 200 may estimate the endpoint values for the native formation fluid and the pure OBM may be obtained, and the OBM filtrate contamination level may be determined. As discussed above, the power-law function (e.g., EQ. 1) may be used to fit fluid property parameters measured with the sampling tool 12, and to determine the endpoint values for the native formation fluid. However, as discussed below, focused sampling tools may not have the same flow regime as the unfocused sampling tools. Therefore, the power-law model may not match the fluid property data generated with the focused sampling tools. As such, the endpoint values and OBM contamination levels determined based on the power-law model may be inaccurate.

Figure 18:
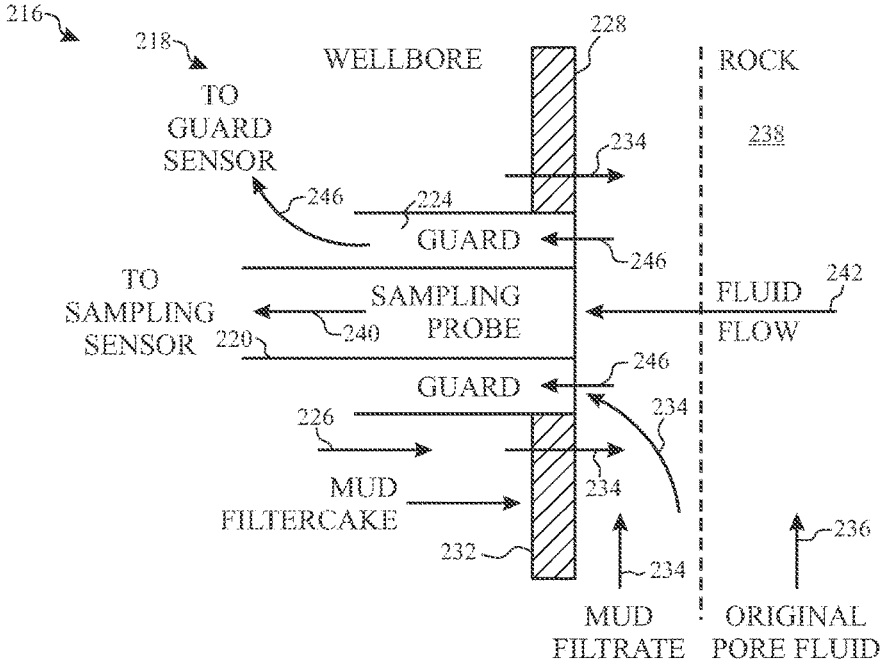
FIG. 18 depicts a geometrical model of a focused sampling tool, in accordance with one or more embodiments of the present disclosure.

FIG. 18 illustrates an embodiment of a geometrical model 216 associated with a focused sampling tool (e.g., the sampling tool 12). In the model 216, the focused sampling tool includes a multi-intake probe 218 that includes a sampling probe 220 and a guard 224 surrounding the sampling probe 220. As discussed above, the drilling fluids (e.g., the oil-based mud) may penetrate the formation, thereby contaminating the native formation fluid. For example, in the illustrated embodiment, drilling mud 226 penetrates formation wall 228. A portion of the drilling mud 226 (e.g., suspended solids) may form a mud filter cake 232 against the formation wall 228 as mud filtrate 234 flows through the formation wall 228. The mud filtrate 234 may mix with native formation fluid 236 (e.g., virgin/uncontaminated formation fluid) within formation 238 (e.g., rock), thereby contaminating the native formation fluid 236. In focused sampling, the guard 224 may separate a portion of the mud filter cake 232 and the mud filtrate 234 from the native formation fluid 236 during sampling. In this way, a representative sample of the native formation fluid 236 (e.g., uncontaminated formation fluid) may be collected for analysis in a faster amount of time compared to unfocused sampling.

For example, as illustrated in FIG. 18, a first fraction 240 of a total flow of formation fluid 242 (e.g., the mud filter cake 232, the mud filtrate 234, and the native formation fluid 236) enters the sampling probe 220, and a second fraction 246 of the total formation fluid 242 enters the guard 224. In certain embodiments, the first fraction 240 may have a lower amount of oil-based mud (OBM) contamination (e.g., the mud filter cake 232 and/or mud filtrate 234) compared to the second fraction 246. However, due, in part, to the fractional flow of the formation fluid (e.g., the mud filter cake 232, the mud filtrate 234, and the native formation fluid 236) through the focused sampling tool, the focused sampling tool may not have the flow regimes 54, 56, 58 discussed above. Therefore, it may be difficult to accurately determine the value of the γ exponent (e.g., −5/12, −2/3) in the power law functions (e.g., EQ. 1) used to estimate the endpoint values of the native formation fluid 236 when using focused sampling tools.

As discussed above, the endpoint values may be sensitive to the value of the exponent γ and fitting intervals (e.g., the flow regimes 54, 56, 58). Therefore, because the γ exponent in the power-law function may be inaccurate when using focused sampling tools, the power-law function may not match the measured fluid property data. However, in accordance with certain embodiments disclosed herein, the endpoint values for the native formation fluid 236 and/or the pure mud filtrate 234 may be accurately estimated using other regression models such as an exponential function rather than the power-law function defined in EQ. 1.

Returning to FIG. 17, the method 208 includes selecting a geometric fitting model to match the measured fluid property data (block 250) obtained from the downhole fluid analysis using the focused sampling tool. In accordance with the disclosed embodiments, the computer system 200 may select an exponential function, a logistic function, a sigmoid family function, a simplified power-law function, or any other suitable function that does not include the γ exponent to estimate the endpoint value of the native formation fluid 236 and/or the mud filtrate 234. In certain embodiments, the selected geometric fitting model may be derived from the power-law function. For example, in focused sampling, the oil-based mud (OBM) concentration in a sample line (e.g., flowline of the sampling probe 220) is proportional to the following expression:

$$R^{-1}e^{-\beta R^2} \tag{15}$$

where,

R is the spherical radial coordinate (e.g., radius of rock/formation 238 where the formation fluid 242 has been withdrawn);

V is the volume of fluid pumped from the geological formation to the drilling fluid analysis;

β is an adjustable parameter.

The power-law decay model generally used in downhole fluid analysis using the sampling tool 12 (e.g., focused and/or unfocused) to estimate endpoint values for the native formation fluid 236 and/or the pure mud filtrate 234 may have the following relationship:

$$v_{obm} = \frac{OD_{oi} - OD_i}{OD_{oi} - OD_{obmi}} = \frac{f_o - f}{f_o - f_{obm}} = \frac{b_o - b}{b_o - b_{obm}} = \frac{\rho_o - \rho}{\rho_o - \rho_{obm}} = \beta V^{-\gamma} \tag{16}$$

Derivation of the power-law decay model shown in EQ. 16 is described in U.S. patent application Ser. No. 14/697,382 assigned to Schlumberger Technology Corporation and is hereby incorporated by reference in its entirety. Based on EQs. 15 and 16, the spherical radial coordinate R is proportional to $V^{-1/3}$ assuming fluid flow is spherically symmetrical, and therefore, the oil-based mud (OBM) concentration in the formation fluid ($\eta_{obm}$) is proportional to the following expression:

$$v_{obm} = \frac{OD_{oi} - OD_i}{OD_{oi} - OD_{obmi}} = \frac{f_o - f}{f_o - f_{obm}} = \frac{b_o - b}{b_o - b_{obm}} = \frac{\rho_o - \rho}{\rho_o - \rho_{obm}} = \alpha V^{1/3} e^{-\beta V^{2/3}} \tag{17}$$

where α and β are adjustable parameters determined from fitting EQ. 17 to the measured fluid property data.

Based on the relationship defined in EQ. 17, the endpoint values for the native formation fluid 236 may be obtained using the exponential functions defined below (e.g., EQs. 18-21) for the fluid properties of interest, such as OD, GOR (f), ρ, and b.

$$OD_i = OD_{0i} - \alpha(OD_{0i} - OD_{obm})V^{1/3}e^{-\beta V^{2/3}} = OD_{0i} - \alpha_1 V^{1/3}e^{-\beta V^{2/3}} \tag{18}$$

$$f = f_0 - \alpha(f_0 - f_{obm})V^{1/3} - e^{-\beta V^{2/3}} = f_0 - \alpha_2 V^{1/3}e^{-\beta V^{2/3}} \tag{19}$$

$$\rho = \rho_0 - \alpha(\rho_0 - \rho_{obm})V^{1/3} - e^{-\beta V^{2/3}} = \rho_0 - \alpha_3 V^{1/3}e^{-\beta V^{2/3}} \tag{20}$$

$$b_i = b_0 - \alpha(b_0 - b_{obm})V^{1/3}e^{-\beta V^{2/3}} = b_0 - \alpha_4 V^{1/3}e^{-\beta V^{2/3}} \tag{21}$$

EQs. 18-21 may be used to fit the clean up data generated in the sample flowline (e.g., the sampling probe 220) and estimate (e.g., $OD_{0i}$, $f_0$, $\rho_0$, $b_0$) the endpoint value of the native formation fluid 236 and/or the mud filtrate 234 when using the focused sampling tool. As discussed above, the pump out volume V (or time (t)) may be extrapolated to infinity to obtain the endpoint value of the native formation fluid 236 and the mud filtrate 234.

Figure 19:
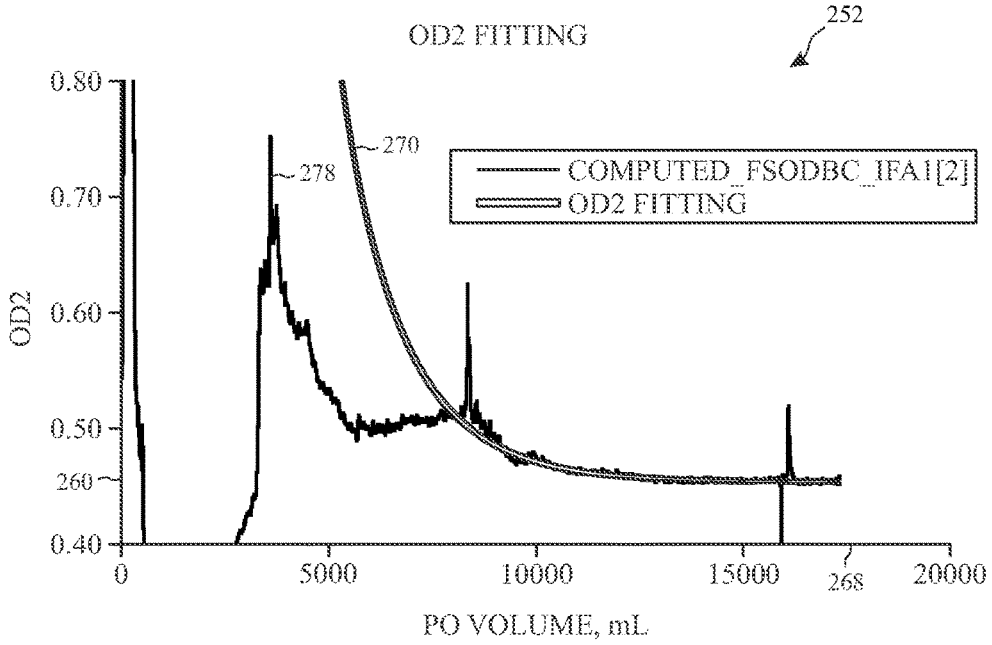
FIG. 19 depicts a graph reflecting a relationship between a multi-parameter exponential function and simulated optical density data corresponding to a focused sampling tool, in accordance with one or more embodiments of the present disclosure.
Figure 20:
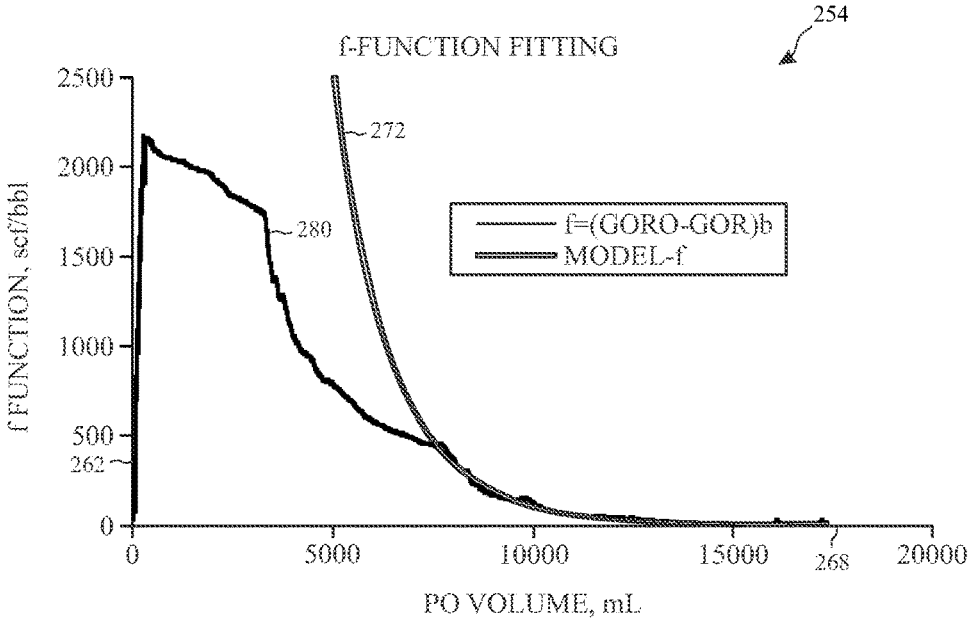
FIG. 20 depicts a graph reflecting a relationship between a multi-parameter exponential function and simulated f-function data corresponding to a focused sampling tool, in accordance with one or more embodiments of the present disclosure.
Figure 21:
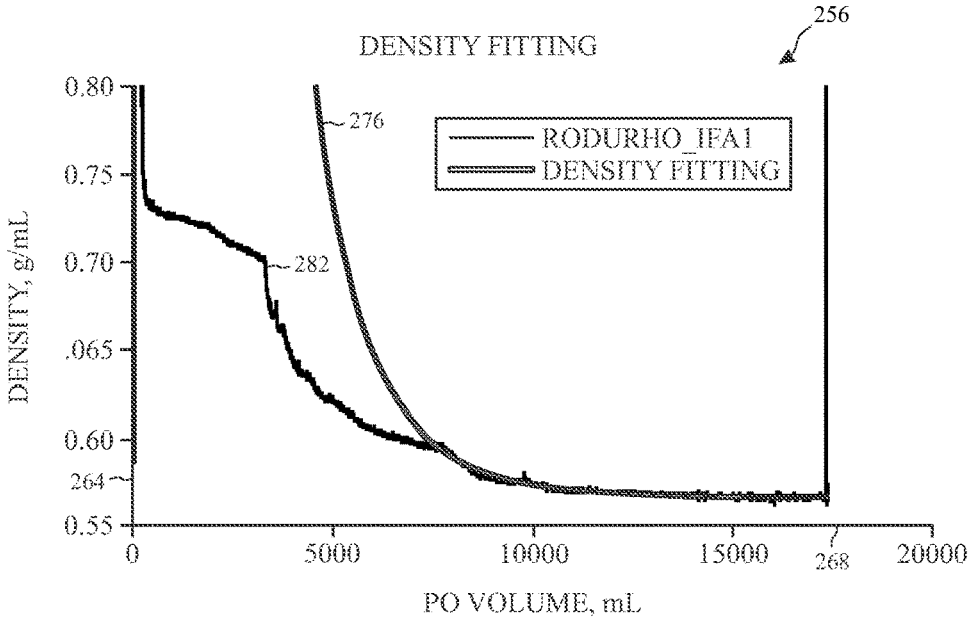
FIG. 21 depicts a graph reflecting a relationship between a multi-parameter exponential function and simulated density data corresponding to a focused sampling tool, in accordance with one or more embodiments of the present disclosure.

FIGS. 19-21 are representative plots showing data fitting for various parameters of the formation fluid using the exponential functions expressed in EQs. 18-21. For example, FIGS. 19-21 illustrate plots 252, 254, and 256 for OD 260 (at channel 2), f-function 262, and density (ρ) 264, respectively, vs. pump out volume (V) 268 (or time (t)) for a simulated formation fluid as analyzed by a focused sampling tool. As shown, in the plots 252, 254, and 256 model data points 270, 272, 276 fit simulated data points 278, 280, 282, respectively, at pumped out volumes greater than approximately 7,000 milliliters (mL). However, at pumped out volumes less than approximately 7,000 mL, the model data points 270, 272, 276 do not match the data points 278, 280, 282.

In field applications (e.g., at the wellbore) clean up behavior may deviate from ideal scenarios due, in part, to changes in drilling mud invasion depth, native formation fluid-filtrate viscosity contrast, vertical/horizontal permeability ratio, and various probe geometries of the sampling tool 12. Consequently, the regression models expressed in EQs. 19-21 may need to be simplified to account for various scenarios affecting the clean up behaviors. Otherwise, the endpoint value of the native formation fluid and/or pure mud filtrate may be inaccurate due to data over fitting resulting from multiple parameters (e.g., α, β, γ, and V) in the models.

Figure 22:
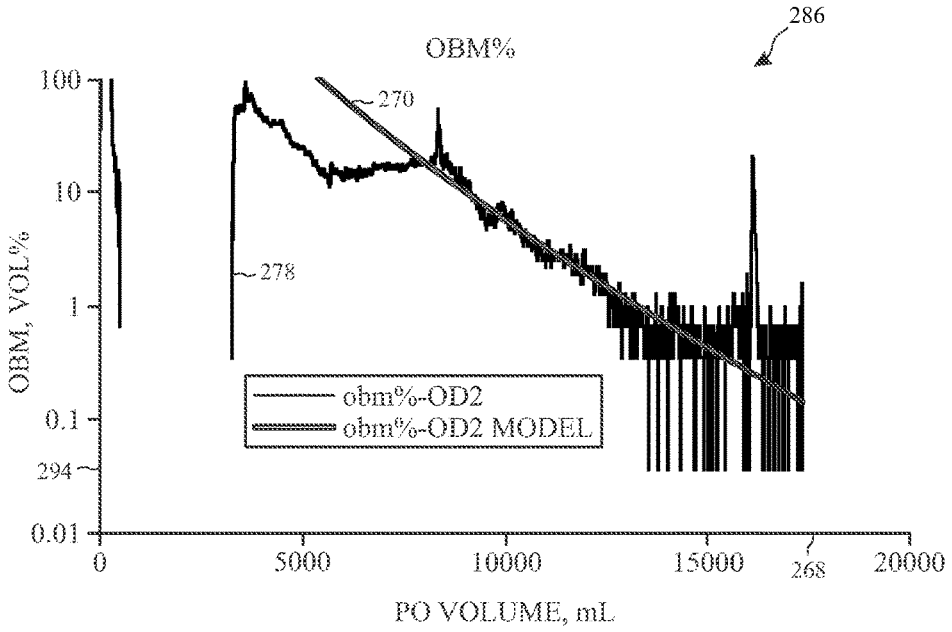
FIG. 22 depicts a logarithmic graph reflecting a linear relationship between a portion of the optical density data of FIG. 19 and the multi-parameter exponential function, in accordance with one or more embodiments of the present disclosure.
Figure 23:
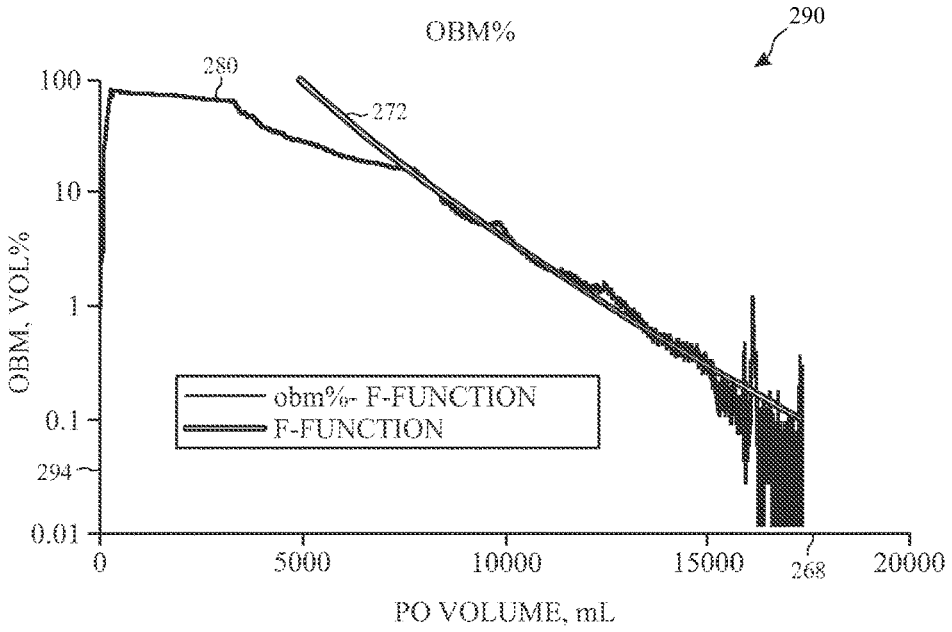
FIG. 23 depicts a logarithmic graph reflecting a linear relationship between a portion of the f-function data of FIG. 20 and the multi-parameter exponential function, in accordance with one or more embodiments of the present disclosure.
Figure 24:
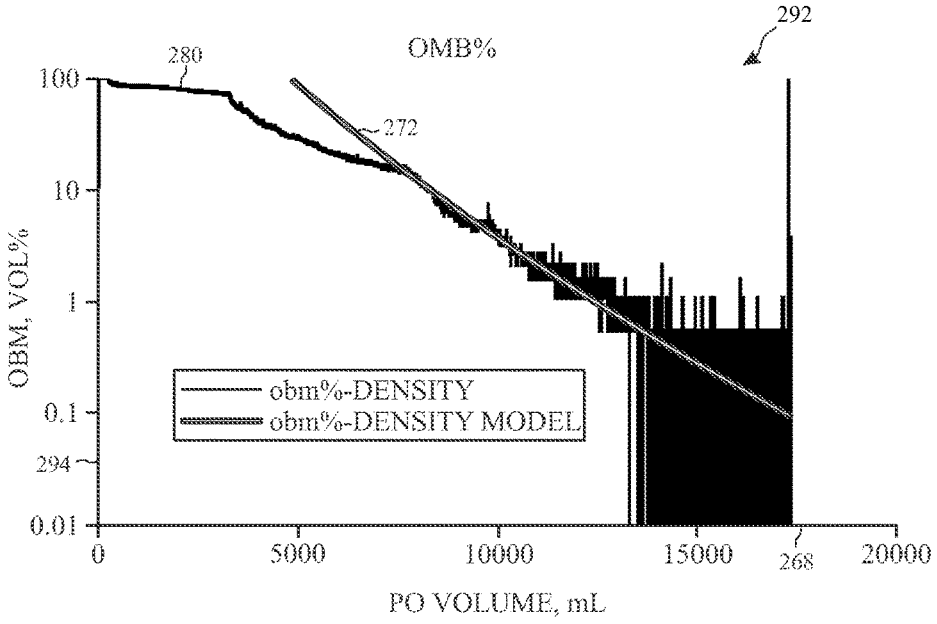
FIG. 24 depicts a logarithmic graph reflecting a linear relationship between a portion of the density data of FIG. 21 and the multi-parameter exponential function, in accordance with one or more embodiments of the present disclosure.

For example, FIGS. 22-24 illustrate plots 286, 290, 292, respectively, for oil-based mud (OBM) filtrate contamination 294 (logarithmic scale) in percent volume (% vol) vs the pumped out (PO) volume 268 in mL. The % vol of the OBM filtrate contamination 294 in plots 286, 290, 292 may be determined using the optical density (OD), the f-function, and the density (ρ) endpoint values obtained from extrapolating the model data points 270, 272, 276 from the plots 252, 254, and 256, respectively. As illustrated in FIGS. 22-24, the logarithm of the OBM filtrate contamination 294 has a linear relationship with the PO volume 268 when the OBM filtrate contamination is between approximately 15% and 1%. However, for OBM filtrate contamination greater than approximately 15% or less than approximately 1% the logarithm of the OBM filtrate contamination 294 and the PO volume 268 are not linearly related. As discussed above, this may be due, in part, to over fitting the model to the data points 278, 280, 282 (e.g., EQ. 18-21).

To mitigate over fitting, EQs. 18-21 may be simplified to include a coefficient (e.g., α) and one adjustable parameter (e.g., β) without affecting the generality of the exponential decay. In this way, the oil-based mud (OBM) filtrate contamination may be fitted by the simplified exponential function associated with the formation fluid fraction flowing through the sample line (e.g., the sampling probe 220) of the focused sampling tool. The simplified exponential function may be expressed as follows:

$$v_{obm} = \frac{OD_{0i} - OD_i}{OD_{0i} - OD_{obmi}} = \frac{f_o - f}{f_o - f_{obm}} = \frac{b_o - b}{b_o - b_{obm}} = \frac{\rho_o - \rho}{\rho_o - \rho_{obm}} = \alpha e^{-\beta V} \tag{22}$$

EQ. 22 may be further simplified by rewriting as a logarithmic function expressed as follows:

$$\ln\left[\frac{OD_{0i} - OD_i}{\alpha_1}\right] = \ln\left[\frac{f_o - f}{\alpha_2}\right] = \ln\left[\frac{b_o - b}{\alpha_3}\right] = \ln\left[\frac{\rho_o - \rho}{\alpha_4}\right] = -\beta V \tag{23}$$

Plotting the natural log of the fluid property parameter (e.g., OD, f-function, shrinkage factor (b), density (ρ), etc.) from EQ. 23 over the pump out (PO) volume 268 and/or time (t), a linear relationship between the fluid property parameter and the PO volume 268 (or time) may be obtained. Accordingly, the modeled data obtained from the logarithmic function in EQ. 23 may be extrapolated to determine the endpoint values for the native formation fluid 236 and/or the pure oil-based mud (OBM) filtrate 234 with increased accuracy compared to endpoint values determined based on the power law function. For example, the regression model (e.g., EQ. 23) may predict an asymptote of a growth curve (e.g., a plot of the measured property data). The asymptote may correspond to the estimated fluid property of the native formation fluid 236.

Figure 25:
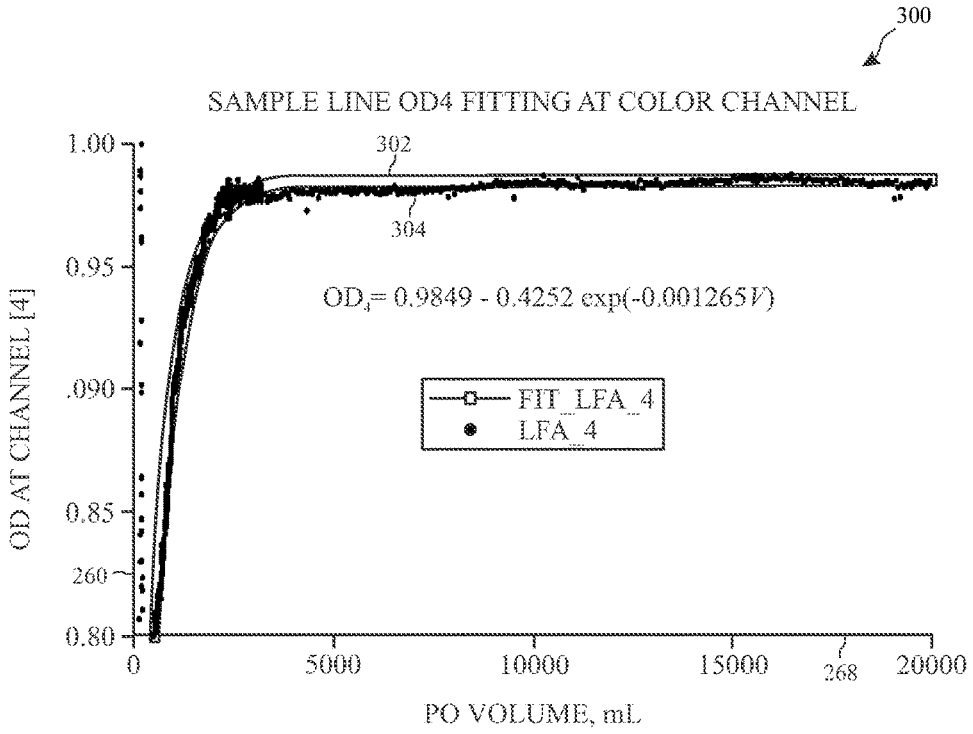
FIG. 25 depicts a logarithmic graph reflecting a match between a simplified exponential function and simulated optical density data on corresponding to a focused sampling tool, in accordance with one or more embodiments of the present disclosure.

FIG. 25 illustrates a plot 300 of the OD 260 (at color channel 4) vs PO volume 268 for a low gas-to-oil ratio (GOR) (e.g., less than approximately 200 standard cubic feet per Stock Tank Barrel (scf/STB)) heavy oil field sample. As illustrated, OD model data points 302 generated based on the simplified exponential function in EQ. 22 substantially fit (e.g., match) OD clean up data points 304 (e.g., real-time data) measured using a focused sampling tool. A similar behavior is also observed when plotting model data points and the respective measured fluid property data for f-function, density (ρ), shrinkage factor (b), among others.

Therefore, due, in part, to the fit between EQ. 22 and the measured fluid property data, the computer system 200 may select the simplified exponential model, or any other suitable model that includes two or more parameters (e.g., a coefficient α and one adjustable parameter β), to determine the endpoint value for the native formation fluid 236 and/or the pure oil-based mud (OBM) filtrate 234. In certain embodiments, a derivative of the simplified exponential function in EQ. 22 for each fluid property of interest may be obtained. The derivative of the fluid properties (e.g., optical density (OD), f-function, shrinkage factor (b), density (ρ), etc.) may be linearly associated with a corresponding fluid property. For example, a plot of the derivative of the OD vs the OD itself (e.g., the data points 278, 304) may show a linear relationship. Plotting the derivative of the fluid property with the fluid property itself may facilitate quality control and/or validation of the simplified exponential function in EQ. 22. The derivative functions for OD, f-function, density (ρ), and shrinkage factor (b) are expressed as follows:

$$\frac{dOD_i}{dV} = \beta\alpha_1 e^{-\beta V} = \beta_1(OD_{0i} - OD_i) \tag{24}$$

$$\frac{df}{dV} = \beta\alpha_2 e^{-\beta V} = \beta_2(f_0 - f) \tag{25}$$

$$\frac{d\rho}{dV} = \beta\alpha_3 e^{-\beta V} = \beta_3(\rho_0 - \rho) \tag{26}$$

$$\frac{db}{dV} = \beta\alpha_4 e^{-\beta V} = \beta_4(b_0 - b) \tag{27}$$

The simplified geometric models, such as the model in EQ. 22, may also be validated using numerical simulations generated by CFD software (e.g., STAR-CCM+ available from CD-adapco). The numerical simulations may be used to study clean up and sampling behavior of focused sampling probes, such as the sampling tool 12. For example, a simulated formation fluid may be generated by a series of numerical simulations obtained using the CFD software. In the formation 242, fluids (e.g., the oil-based mud (OBM) filtrate 234 and the native formation fluid 236 (e.g., hydrocarbons)) may be miscible and compressible. The numerical simulations model the formation 238 as porous media, and the level of OBM filtrate contamination (e.g., the volume fraction of the OBM filtrate 234 in the formation fluid 242) may be obtained through a transport equation. Analysis of the numerical simulations indicates that the formation fluid 242 flowing through the guard 224 generally follows power-law function behavior. In contrast, the formation fluid 242 flowing through the sampling probe 220 may have a decline rate that is faster than the power-law function behavior. Therefore, the formation fluid 242 in the sampling probe flowline of the focused sampling tool may not follow power-law function behavior, such as the behavior modeled using EQs. 1 and/or 10.

Therefore, based on the decline rate information obtained from CFD software simulations, a synthetic OD channel may be generated by the linear mixing rules (e.g., EQ. 10) using known OBM filtrate (e.g., the OBM filtrate 228) and/or native formation fluid (e.g., the native formation fluid 228) endpoint value. Various regressions models (e.g., power-law function, Gaussian function, logistic regression, Gompertz function, Weibull growth model, exponential functions, and simplified versions of the aforementioned models) may be subsequently applied to simulated data obtained from the synthetic OD channel to predict the endpoint value for the native formation fluid and, if the endpoint value for the OBM filtrate is known, the OBM contamination level. The predicted endpoint value and the OBM contamination level may be compared with field data to validate the selected regression model(s).

Figure 26:
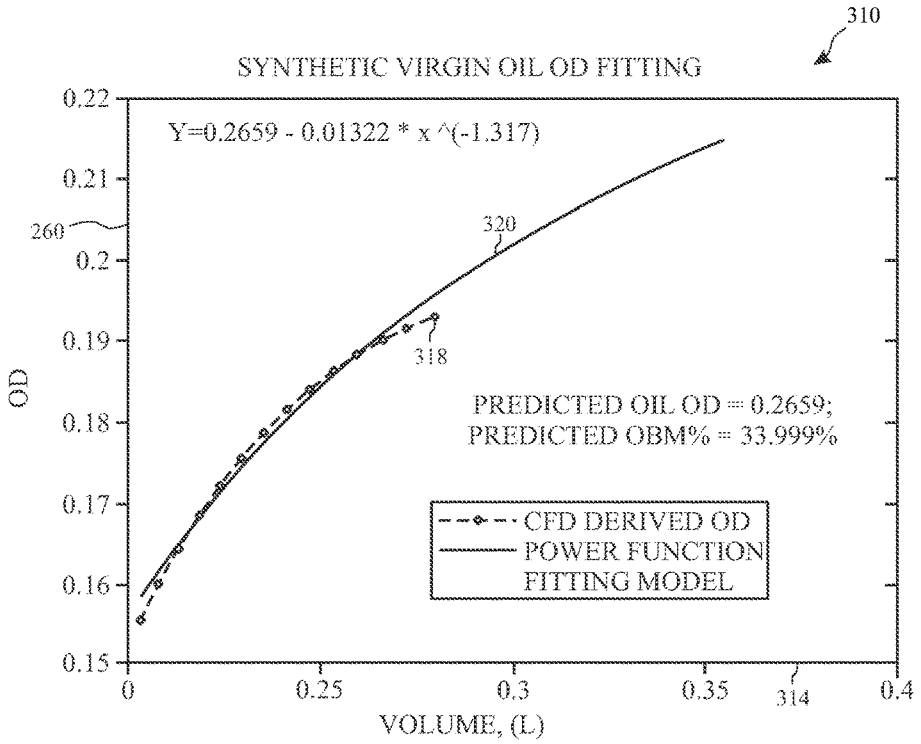
FIG. 26 depicts a graph reflecting a model mismatch between a power-law function and simulated optical density data corresponding to a focused sampling tool, in accordance with one or more embodiments of the present disclosure.
Figure 27:
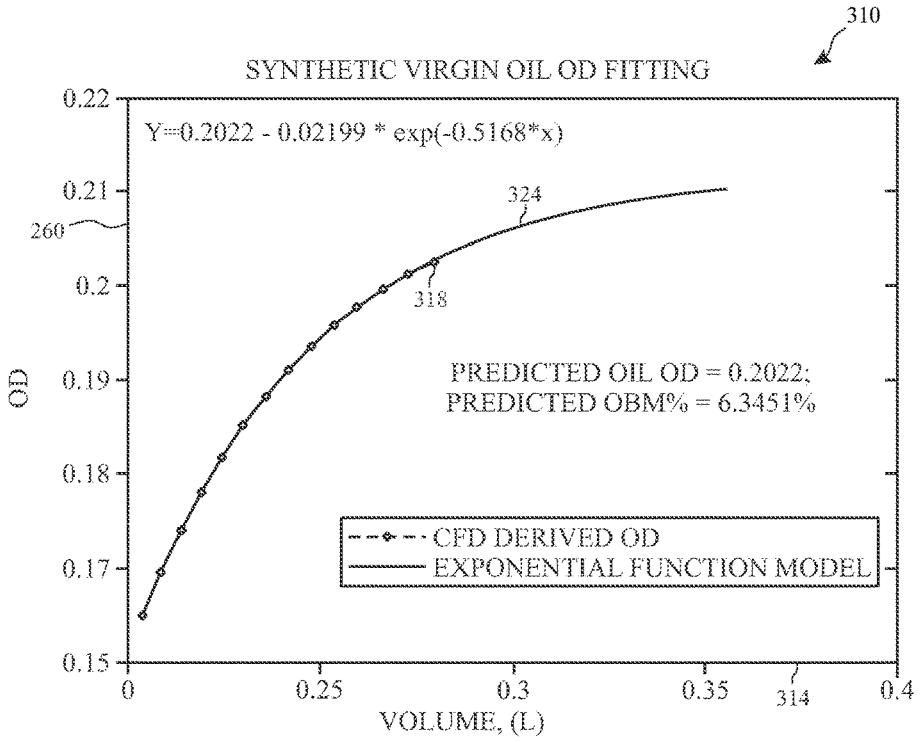
FIG. 27 depicts a graph reflecting a model match between the simplified exponential function and simulated optical density data corresponding to a focused sampling tool, in accordance with one or more embodiments of the present disclosure.

For example, FIGS. 26 and 27 illustrate plots 310 and 312, respectively, for the OD 260 vs volume 314 (in liters (L)) of simulated formation fluid behavior through a sampling probe (e.g., the sampling probe 220) of a focused sampling tool. As shown in FIG. 26, the simulated data points 318 have a faster decline rate compared to the power-law function curve 320. As such, endpoint values and OBM contamination levels obtained based on the power-law function (e.g., EQs. 1 and/or 10) may be inaccurate because the formation fluid does not follow power-law function behavior.

However, as shown in FIG. 27, the simulated data points 318 match the decline rate of exponential function curve 324 (obtained from EQ. 22). Therefore, because the decline rate shown by the simulated formation fluid (e.g., the simulated data points 318) is exponential rather than power for focused sampling applications, exponential models, such as the simplified exponential model defined in EQ. 22, may be used determine the endpoint value for the native formation fluid 236 and/or pure OBM filtrate 234 and OBM filtrate contamination levels with improved accuracy compared to the power-law functions.

Plots similar to those illustrated in FIGS. 26 and 27 (e.g., the plots 310, 312) may be generated for the other regression models (e.g., power-law function, Gaussian function, logistic regression, Gompertz function, Weibull growth model, and simplified models associated with the aforementioned models) to validate the model for use in focused sampling downhole fluid analysis. Accordingly, the computing system 200 may select from the validated regressions models, which does not include the power-law functions in EQs. 1 and 10, to estimate the endpoint value of the native formation fluid and/or pure mud filtrate, and determine a contamination level of the formation fluid for focused sampling applications. For example, in certain embodiments, the computer system 200 may select a logistic model (EQ. 28) to determine the endpoint value of the native formation fluid 236. In other embodiments, the computing system 200 may select an error function fitting model (EQ. 29), a simplified power-law function (EQ. 30), or Sigmoid Family function (EQs. 31-34) to determine the endpoint value for the native formation fluid 236. In certain embodiments, the computer system 200 may use two or more regression models to fit the measured fluid property data. For example, the computing system 200 may use the simplified exponential model defined in EQ. 22 and the models in EQs. 28-35. This may facilitate validation and quality control of the selected regression model used to determine the endpoint value for the native formation fluid and/or the pure mud filtrate.

$$\frac{v_{obm}}{1 - v_{obm}} = \alpha V^{-\beta} \tag{28}$$

$$v_{obm} = \frac{1}{2} erfc(\alpha R + \beta) \tag{29}$$

$$v_{obm} = \alpha V^{-\beta} \tag{30}$$

$$v_{obm} = \frac{1}{1 + \alpha e^{\beta R}} \tag{31}$$

$$v_{obm} = 1 - e^{-e^{\alpha - \beta V}} \tag{32}$$

$$v_{obm} = e^{-\alpha V^{\beta}} \tag{33}$$

$$v_{obm} = 1 - \tanh(\alpha R + \beta) \tag{34}$$

Returning to FIG. 17, once the computer system 200 selects the regression model that best matches the measured fluid property data, according to the acts of block 250, the method 208 determines the endpoint value corresponding to the native formation fluid 236 (e.g., uncontaminated formation fluid) and the pure oil-based mud (OBM) filtrate 234 (block 330). For example, in certain embodiments, reliable and accurate endpoints may be obtained by extrapolating the model data (e.g., the model data 302) for each respective fluid property parameter. As discussed above, the selected geometric model predicts an asymptote of the growth curve (e.g., the plotted measured fluid property data), which corresponds to the estimated endpoint value (e.g., fluid property) of the native formation fluid. In one embodiment, the formation fluid flowing into the sampling probe 220 at the beginning of sampling may be the pure OBM filtrate 234. Therefore, the endpoint value for the pure OBM filtrate 234 may be determined from the beginning of the clean up data (e.g., the data points 304). Due to the fit between the measured and modeled data points (e.g., the data points 302, 304), robust and reliable endpoint values (e.g., fluid and composition properties of the native formation fluid 236 and the pure mud filtrate 234) may be obtained based on the simplified regression models (EQ. 22 and 28-35) disclosed herein compared to the power-law function for focused sampling applications.

Figure 28:
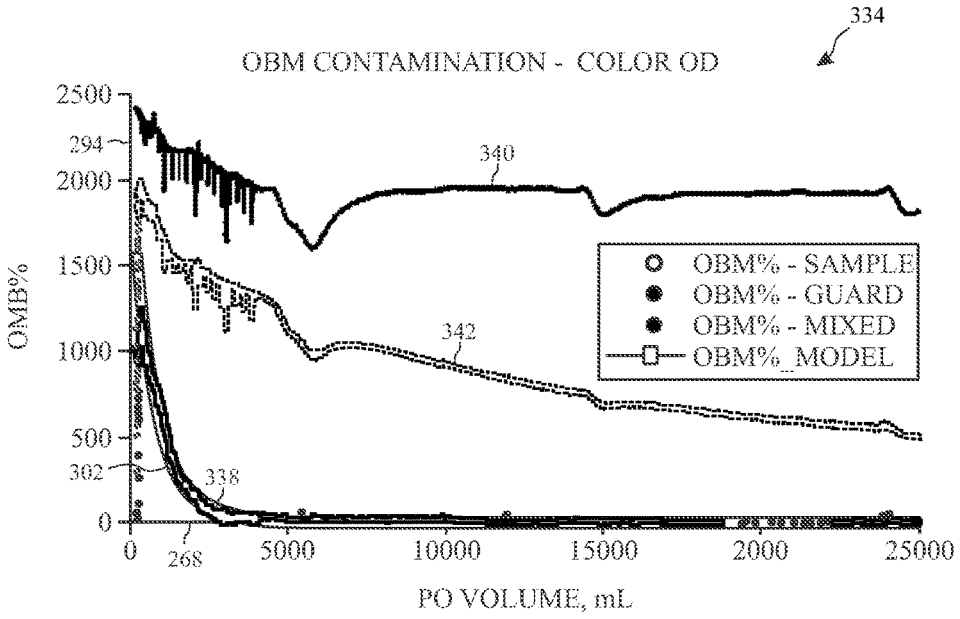
FIG. 28 depicts a semi-logarithmic graph reflecting oil-based mud contamination decline curve of sampling probe data, a guard data, and a mixture of sampling and guard data from a focused sampling tool, and a proper fitting of the simplified exponential function of the sampling probe data, in accordance with one or more embodiments of the present disclosure.
Figure 29:
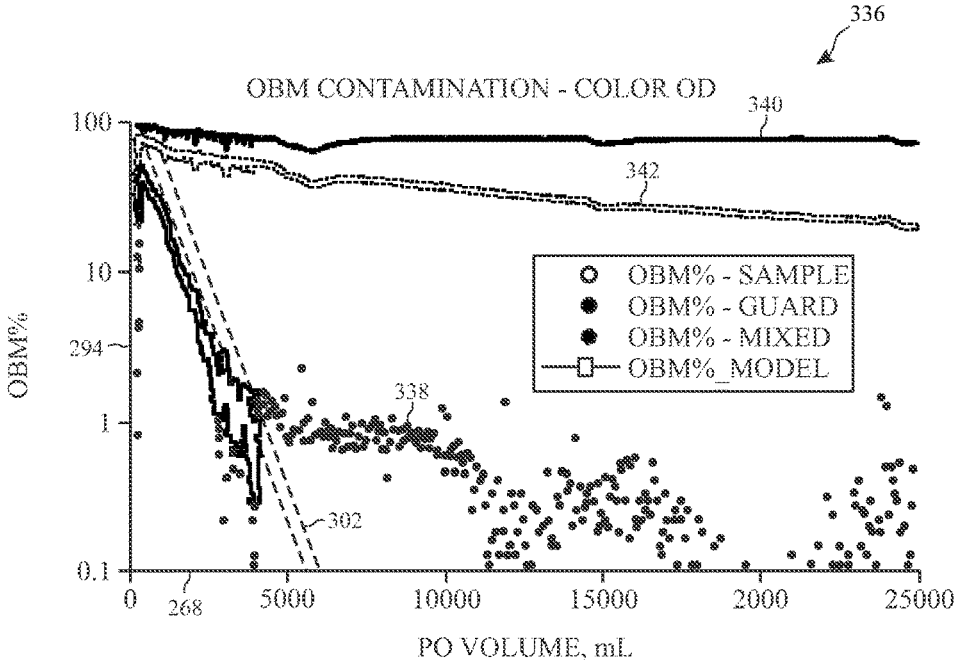
FIG. 29 depicts a portion of the semi-logarithmic graph of FIG. 28 reflecting a linear relationship between the simplified exponential function and the sampling probe data, in accordance with one or more embodiments of the present disclosure.

Once the endpoint value for the native formation fluid 236 and the mud filtrate 234 are known, mixing rules for each parameter (e.g., OD, GOR, shrinkage (b), and density (ρ))

may be used to estimate the oil-based mud (OBM) contamination in the formation fluid 242 (block 332). For example, FIGS. 28 and 29 illustrate plots 334 and 336 of the OBM filtrate contamination 294 vs the pumpout (PO) volume 268 determined using the mixing rules for the OD (e.g., EQ. 10). In the illustrated embodiments, the OBM filtrate contamination decline rate for sampling data points 338 (e.g., from the sampling probe 220), guard data points 340 (e.g., from the guard 224), and mixed data points 342 (e.g., the sampling and guard data points 338, 340) each follow a different decline rate. As shown in FIG. 28, the model data points 302 obtained from the simplified exponential model (e.g., EQ. 22) match the sampling data points 338. Additionally, the semi-logarithmic plot 336 illustrated in FIG. 29 shows a linear relationship between the model data points 302 (e.g., determined based on the simplified exponential model defined in EQ. 22) and the sample data points 338 for OBM filtrate contamination greater than or equal to approximately 1%. A similar pattern may be observed for the other fluid properties (e.g., the f-function, the shrinkage factor (b), the density (ρ), and the composition mass fraction ($m_j$)).

The exponential model (e.g., EQ. 22) disclosed herein may facilitate quality control for determining endpoint values and mud filtrate contamination. For example, the exponential model may be combined with other regression models (e.g., error function fitting model, power-law function, Gaussian function, logistic regression, Gompertz function, Weibull growth model, and simplified models associated with the aforementioned models) to determine if the exponential model is representative of the clean-up data. By combining two or more regression models to fit the clean-up data, a user of the sampling tool 12 may detect extrapolation errors that may result in accurate mud filtrate contamination levels.

Using two or more of the regression models discussed above to fit measured data (e.g., the clean-up data) and determine the native formation fluid properties may provide the user with a high degree of confidence that the contamination level derived from the regression models is correct or incorrect. For example, if the contamination level determined from each regression model is consistent, the user may have a high level of confidence that the derived contamination level in the formation fluid is correct, and that the model used to determine the endpoint values properly fits the clean-up data. However, if the contamination level determined from each regression model is inconsistent, the regression model selected to determine the endpoint values for the native formation fluid and/or pure mud filtrate may be inaccurate. In certain embodiments, a difference between the contamination levels determined from the two or more regression models may indicate an upper and lower bound of the true endpoint value for the native formation fluid and/or pure mud filtrate. Additionally, in other embodiments, the difference between the contamination levels may be used to set a maximum percentage difference threshold that could be used to set model prediction confidence levels. The average between the two or more models may also be used to determine an accurate and consistent contamination output.

As discussed above, and shown in the data presented herein, the disclosed exponential function for determining endpoint values for the native formation fluid and/or pure mud filtrate matches the decline rate for data obtained using a focused downhole acquisition tool (e.g., the downhole acquisition tool 12). In addition, the disclosed exponential function may be used to provide reliable and consistent estimation for native formation fluids and pure mud filtrates for drilling fluid analysis (e.g., in real time). Comparison of multiple regression models may facilitate quality control and confidence levels for determining fluid endpoint values and mud filtrate contamination for focused sampling applications.

The terms "approximately," "about," and "substantially" as used herein represent an amount close to the stated amount that still performs a desired function or achieves a desired result. For example, the terms "approximately," "about," and "substantially" may refer to an amount that is within less than 10% of, within less than 5% of, within less than 1% of, within less than 0.1% of, and within less than 0.01% of a stated amount.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

The invention claimed is:

1. A method comprising:

operating a downhole acquisition tool in a wellbore in a geological formation, wherein the wellbore or the geological formation, or both contains a fluid that comprises a native reservoir fluid of the geological formation and a contaminant, wherein the downhole acquisition tool comprises a focused sampling tool;

receiving a portion of the fluid into the downhole acquisition tool;

measuring a fluid property of the portion of the fluid using the downhole acquisition tool;

estimating, in a processor coupled to the downhole acquisition tool, a fluid property of the native reservoir fluid based on the measured fluid property of the portion of the fluid and a regression model configured to predict an asymptote of a growth curve, wherein the asymptote corresponds to the estimated fluid property of the native formation fluid, and wherein the regression model comprises a geometric fitting model other than a power-law model;

wherein the geometric fitting model comprises applying the following relationship:

$$v_{obm}=\alpha e^{-\beta V}$$

where $v_{obm}$ represents a volume fraction of the contaminate in the portion of the fluid;

α represents a coefficient;

β represents a parameter based on the fluid property other than the volume fraction of the contaminant in the portion of the fluid; and V represents a pumpout volume of the fluid; and determine a contamination level of the fluid based on the fluid property of the native reservoir fluid.

2. The method of claim 1, comprising fitting the geometric model to the measured fluid property data and extrapolating the geometric model to infinity to predict the asymptote.

3. The method of claim 1, wherein the geometric fitting model comprises an exponential model, a logistic model, or a sigmoid family model.

4. The method of claim 1, wherein the geometric fitting model comprises only one coefficient and one additional parameter.

5. The method of claim 1, wherein the fluid property comprises optical density, gas-to-oil ratio, density, shrinkage factor, composition, or any combination thereof.

6. The method of claim 1, wherein the contaminant comprises an oil-based mud or a water-based mud.

7. A downhole fluid testing system comprising:

a downhole acquisition tool housing configured to be moved into a wellbore in a geological formation, wherein the wellbore or the geological formation, or both, contains a fluid that comprises a native reservoir fluid of the geological formation and a contaminant, wherein the downhole fluid testing system comprises a focused sampling tool;

a sensor disposed in the downhole acquisition tool housing that is configured to analyze portions of the fluid and obtain sets of fluid properties of the portions of the fluid; and a data processing system configured to estimate a fluid property of the native reservoir fluid based on at least one fluid property from the sets of fluid properties of the portion of the fluid and a geometric fitting model comprising two or more parameters, wherein the geometric fitting model is configured to predict an asymptote of a growth curve, and wherein the asymptote corresponds to the estimated fluid property of the native formation fluid;

wherein the geometric fitting model comprises the following relationship:

$$v_{obm}=\alpha e^{-\beta V}$$

where $v_{obm}$ represents a volume fraction of the contaminate in the portion of the fluid;

$\alpha$ represents a coefficient;

$\beta$ represents a parameter based on the fluid property other than the volume fraction of the contaminant in the portion of the fluid; and V represents a pumpout volume of the fluid;

determine a contamination level of the portion of the fluid based on the fluid property of the native reservoir fluid.

8. The system of claim 7, wherein the data processing system is disposed within the downhole acquisition tool housing, or outside the downhole acquisition tool housing at the surface, or both within the downhole acquisition tool housing and outside the downhole acquisition tool housing at the surface.

9. The system of claim 7, wherein the geometric fitting model is not a power-law model.

10. The system of claim 7, wherein the geometric fitting model matches a decline curve associated with the contaminant in the fluid.

11. The system of claim 7, wherein the geometric model comprises an exponential model, a logistic model, a sigmoid family model, or a power-law model.

12. One or more tangible, non-transitory, machine-readable media comprising instructions to:

receive a fluid parameter of a portion of fluid as analyzed by a focused downhole acquisition tool in a wellbore in a geological formation, wherein the wellbore or the geological formation, or both, contains the fluid, wherein the fluid comprises a mixture of a native reservoir fluid of the geological formation and a contaminant; and estimate a fluid property of the native reservoir fluid based on the fluid parameter of the portion of the fluid and a geometric fitting model comprising two or more parameters, wherein the geometric fitting model matches a decline curve associated with the contaminant in the mixture partially to the following relationship:

$$v_{obm}=\alpha e^{-\beta V}$$

where $v_{obm}$ represents a volume fraction of the contaminant in the portion of the fluid;

$\alpha$ represents a coefficient;

$\beta$ represents a parameter based on the fluid parameter other than the volume fraction of the contaminant in the portion of the fluid; and V represents a pumpout volume of the fluid;

determine a contamination level of the portion of the fluid based on the fluid property of the native reservoir fluid.

13. The one or more tangible, non-transitory, machine-readable media of claim 12, wherein the geometric fitting model is configured to predict an asymptote of a growth curve, and wherein the asymptote corresponds to the estimated fluid property of the native formation fluid.

14. The system of claim 12, wherein the geometric model comprises an exponential model, a logistic model, a sigmoid family model, or a power-law model.

* * * * *